US009982374B2

(12) United States Patent
Grassi et al.

(10) Patent No.: US 9,982,374 B2
(45) Date of Patent: May 29, 2018

(54) METHOD FOR PRODUCING A KNITTED ARTICLE, AND ARTICLE THUS PRODUCED

(71) Applicant: GOLDEN LADY COMPANY S.P.A., Castiglione delle Stiviere (MN) (IT)

(72) Inventors: Nerino Grassi, Castiglione delle Stiviere (IT); Paolo Conti, Florence (IT)

(73) Assignee: GOLDEN LADY COMPANY S.P.A., Castiglione delle Stiviere (MN) (IT)

( * ) Notice: Subject to any disclaimer, the term of this patent is extended or adjusted under 35 U.S.C. 154(b) by 219 days.

(21) Appl. No.: 14/897,681

(22) PCT Filed: Jun. 11, 2014

(86) PCT No.: PCT/IB2014/062122
§ 371 (c)(1),
(2) Date: Dec. 11, 2015

(87) PCT Pub. No.: WO2014/199307
PCT Pub. Date: Dec. 18, 2014

(65) Prior Publication Data

US 2016/0135511 A1 May 19, 2016

(30) Foreign Application Priority Data

Jun. 11, 2013 (IT) ..... FI2013A0139
Sep. 11, 2013 (IT) ..... FI2013A0213

(51) Int. Cl.
*D04B 9/42* (2006.01)
*D04B 1/24* (2006.01)
(Continued)

(52) U.S. Cl.
CPC ..... *D04B 9/42* (2013.01); *A41B 11/006* (2013.01); *A41B 11/14* (2013.01); *D04B 1/243* (2013.01);
(Continued)

(58) Field of Classification Search
CPC ... D04B 9/20; D04B 9/24; D04B 9/46; D04B 9/42; D04B 1/243; D04B 15/88; D04B 35/34; A41B 11/14; A41B 11/006
See application file for complete search history.

(56) References Cited

U.S. PATENT DOCUMENTS 2,962,884 A 12/1960 Garrou et al.
3,673,821 A * 7/1972 Johnson ..... A41B 11/14 66/177
(Continued)

FOREIGN PATENT DOCUMENTS

GB 1 235 361 A 6/1971
GB 1 484 901 A 9/1977
WO 02/18689 A2 3/2002

*Primary Examiner* — Danny Worrell
(74) *Attorney, Agent, or Firm* — McGlew and Tuttle, P.C.

(57) ABSTRACT

A method is disclosed for producing a knitted article with two leg pieces and one body on a circular knitting machine with at least one circular needle bed. The method comprises the following steps: a) knitting a first leg piece (3) with continuous motion; b) knitting a first pocket (17) of fabric with continuous motion, starting from an end course (23) of the first leg piece (3); c) knitting a central part (15) of said body with continuous motion; d) knitting a second pocket of fabric (19) with continuous motion starting from the central part of the body up to a start course (29) of a second leg piece (5); e) knitting the second leg piece (5) with continuous motion starting from the start course.

23 Claims, 26 Drawing Sheets

(51) Int. Cl.

| | |
|---|---|
| ***A41B 11/00*** | (2006.01) |
| ***A41B 11/14*** | (2006.01) |
| ***D04B 15/88*** | (2006.01) |
| ***D04B 35/34*** | (2006.01) |

(52) U.S. Cl.
CPC ..... *D04B 15/88* (2013.01); *D04B 35/34* (2013.01); *A41B 2500/10* (2013.01)

(56) References Cited

U.S. PATENT DOCUMENTS

| | | | | | |
|---|---|---|---|---|---|
| 3,748,870 | A | * | 7/1973 | Fregeolle | A41B 11/14 66/177 |
| 3,802,229 | A | * | 4/1974 | Fregeolle | A41B 11/14 66/177 |
| 3,815,385 | A | * | 6/1974 | Gariboldi | D04B 1/243 66/172 R |
| 3,937,039 | A | * | 2/1976 | Anderson | A41B 11/14 66/177 |
| 3,956,909 | A | * | 5/1976 | Negri | D04B 1/243 66/177 |
| 3,985,004 | A | * | 10/1976 | Johnson | D04B 1/243 2/402 |
| 4,000,630 | A | * | 1/1977 | Imboden | D04B 1/243 66/177 |
| 4,015,448 | A | | 4/1977 | Knohl | |
| 4,022,035 | A | | 5/1977 | Lonati | |

* cited by examiner

Fig.1
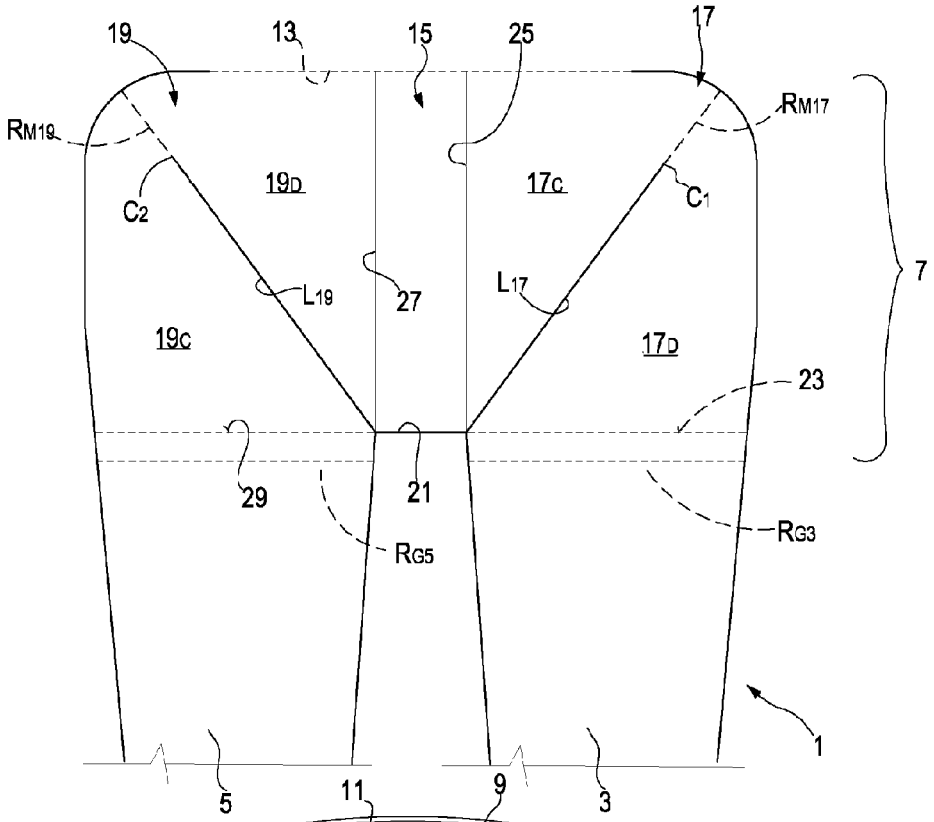
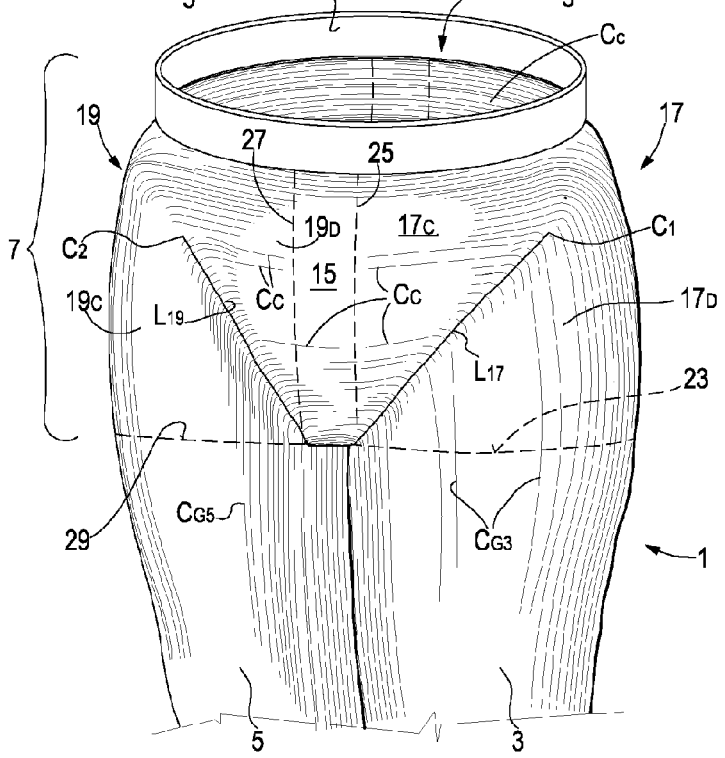
Fig.2

Fig.3B

| | | | | | | | | | | |
|---|---|---|---|---|---|---|---|---|---|---|
| S | S | S | S | S | S | S | S | S | S | S |
| S | S | S | S | S | S | S | S | S | S | S |
| S | S | S | S | S | S | S | S | S | S | S |
| S | S | S | S | S | S | S | S | S | S | S |
| T | B | T | S | S | S | S | S | S | S | S |
| T | B | T | S | S | S | S | S | S | S | S |
| T | B | T | S | S | S | S | S | S | S | S |
| T | B | T | S | S | S | S | S | S | S | S |
| | | | T | B | T | S | S | S | S | S |
| | | | T | B | T | S | S | S | S | S |
| | | | T | B | T | S | S | S | S | S |
| | | | T | B | T | S | S | S | S | S |
| | | | | | | T | B | T | S | S |
| | | | | | | T | B | T | S | S |
| | | | | | | T | B | T | S | S |
| | | | | | | T | B | T | S | S |

| | | | | | | | | | | |
|---|---|---|---|---|---|---|---|---|---|---|
| S | S | S | S | S | S | S | S | S | S | S |
| S | S | S | S | S | S | S | S | S | S | S |
| S | S | S | S | S | S | S | S | S | S | S |
| S | S | S | S | S | S | S | S | S | S | S |
| S | S | S | S | S | S | S | S | T | B | T |
| S | S | S | S | S | S | S | S | T | B | T |
| S | S | S | S | S | S | S | S | T | B | T |
| S | S | S | S | S | S | S | S | T | B | T |
| S | S | S | S | S | T | B | T | | | |
| S | S | S | S | S | T | B | T | | | |
| S | S | S | S | S | T | B | T | | | |
| S | S | S | S | S | T | B | T | | | |
| S | S | T | B | T | | | | | | |
| S | S | T | B | T | | | | | | |
| S | S | T | B | T | | | | | | |
| S | S | T | B | T | | | | | | |

Fig.4B

| | | | | | | | | | | | |
|---|---|---|---|---|---|---|---|---|---|---|---|
| | S | S | S | S | S | S | S | S | S | S | S |
| | S | S | S | S | S | S | S | S | S | S | S |
| | S | S | S | S | S | S | S | S | S | S | S |
| | S | S | S | S | S | S | S | S | S | S | S |
| | T | B | T | S | S | S | S | S | S | S | S |
| | T | B | T | S | S | S | S | S | S | S | S |
| | T | B | T | S | S | S | S | S | S | S | S |
| | T | B | T | S | S | S | S | S | S | S | S |
| | | | | T | B | T | S | S | S | S | S |
| | | | | T | B | T | S | S | S | S | S |
| | | | | T | B | T | S | S | S | S | S |
| | | | | T | B | T | S | S | S | S | S |
| | | | | | | | T | B | T | S | S |
| | | | | | | | T | B | T | S | S |
| | | | | | | | T | B | T | S | S |
| | | | | | | | T | B | T | S | S |
| 1 | S | S | S | S | S | S | S | S | S | S | S |
| 2 | | | | | | | T | B | T | S | S |
| 3 | | | | | | | T | B | T | S | S |
| 4 | | | | | | | T | B | T | S | S |

| | | | | | | | | | | |
|---|---|---|---|---|---|---|---|---|---|---|
| S | S | S | S | S | S | S | S | S | S | S |
| S | S | S | S | S | S | S | S | S | S | S |
| S | S | S | S | S | S | S | S | S | S | S |
| S | S | S | S | S | S | S | S | S | S | S |
| S | S | S | S | S | S | S | S | T | B | T |
| S | S | S | S | S | S | S | S | T | B | T |
| S | S | S | S | S | S | S | S | T | B | T |
| S | S | S | S | S | S | S | S | T | B | T |
| S | S | S | S | S | T | B | T | | | |
| S | S | S | S | S | T | B | T | | | |
| S | S | S | S | S | T | B | T | | | |
| S | S | S | S | S | T | B | T | | | |
| S | S | T | B | T | | | | | | |
| S | S | T | B | T | | | | | | |
| S | S | T | B | T | | | | | | |
| S | S | T | B | T | | | | | | |
| S | S | S | S | S | S | S | S | S | S | S |
| S | S | T | B | T | | | | | | |
| S | S | T | B | T | | | | | | |
| S | S | T | B | T | | | | | | |

Fig.5B

| | | | | | | | | | | |
|---|---|---|---|---|---|---|---|---|---|---|
| S | S | S | S | S | S | S | S | S | S | S |
| S | S | S | S | S | S | S | S | S | S | S |
| S | S | S | S | S | S | S | S | S | S | S |
| S | S | S | S | S | S | S | S | S | S | S |

| | | | | | | | | | | |
|---|---|---|---|---|---|---|---|---|---|---|
| S | S | S | S | S | S | S | S | S | S | S |
| S | S | S | S | S | S | S | S | S | S | S |
| S | S | S | S | S | S | S | S | S | S | S |
| S | S | S | S | S | S | S | S | S | S | S |

| | | | | | | | | | | |
|---|---|---|---|---|---|---|---|---|---|---|
| T | B | T | S | S | S | S | S | S | S | S |
| T | B | T | S | S | S | S | S | S | S | S |
| T | B | T | S | S | S | S | S | S | S | S |
| T | B | T | S | S | S | S | S | S | S | S |

| | | | | | | | | | | |
|---|---|---|---|---|---|---|---|---|---|---|
| S | S | S | S | S | S | S | S | T | B | T |
| S | S | S | S | S | S | S | S | T | B | T |
| S | S | S | S | S | S | S | S | T | B | T |
| S | S | S | S | S | S | S | S | T | B | T |

| | | | | | | | | | | |
|---|---|---|---|---|---|---|---|---|---|---|
| | | | T | B | T | S | S | S | S | S |
| | | | T | B | T | S | S | S | S | S |
| | | | T | B | T | S | S | S | S | S |
| | | | T | B | T | S | S | S | S | S |

| | | | | | | | | | | |
|---|---|---|---|---|---|---|---|---|---|---|
| S | S | S | S | S | T | B | T | | | |
| S | S | S | S | S | T | B | T | | | |
| S | S | S | S | S | T | B | T | | | |
| S | S | S | S | S | T | B | T | | | |

| | | | | | | | | | | |
|---|---|---|---|---|---|---|---|---|---|---|
| | | | | | | T | B | T | S | S |
| | | | | | | T | B | T | S | S |
| | | | | | | T | B | T | S | S |
| | | | | | | T | B | T | S | S |

| | | | | | | | | | | |
|---|---|---|---|---|---|---|---|---|---|---|
| S | S | T | B | T | | | | | | |
| S | S | T | B | T | | | | | | |
| S | S | T | B | T | | | | | | |
| S | S | T | B | T | | | | | | |

| | | | | | | | | | | |
|---|---|---|---|---|---|---|---|---|---|---|
| S | S | S | S | S | S | S | S | S | S | S |
| | | | | | | T | B | T | S | S |
| | | | | | | T | B | T | S | S |
| | | | | | | T | B | T | S | S |

| | | | | | | | | | | |
|---|---|---|---|---|---|---|---|---|---|---|
| S | S | S | S | S | S | S | S | S | S | S |
| S | S | T | B | T | | | | | | |
| S | S | T | B | T | | | | | | |
| S | S | T | B | T | | | | | | |

| | | | | | | | | | | | |
|---|---|---|---|---|---|---|---|---|---|---|---|
| 1 | | | | T | B | T | S | S | S | S | S |
| 2 | | | | T | B | T | S | S | S | S | S |
| 3 | | | | T | B | T | S | S | S | S | S |
| 4 | | | | T | B | T | S | S | S | S | S |

| | | | | | | | | | | |
|---|---|---|---|---|---|---|---|---|---|---|
| S | S | S | S | S | T | B | T | | | |
| S | S | S | S | S | T | B | T | | | |
| S | S | S | S | S | T | B | T | | | |
| S | S | S | S | S | T | B | T | | | |

Fig.6B

| | | | | | | | | | | |
|---|---|---|---|---|---|---|---|---|---|---|
| S | S | S | S | S | S | S | S | S | S | S |
| S | S | S | S | S | S | S | S | S | S | S |
| S | S | S | S | S | S | S | S | S | S | S |
| S | S | S | S | S | S | S | S | S | S | S |

| | | | | | | | | | | |
|---|---|---|---|---|---|---|---|---|---|---|
| S | S | S | S | S | S | S | S | S | S | S |
| S | S | S | S | S | S | S | S | S | S | S |
| S | S | S | S | S | S | S | S | S | S | S |
| S | S | S | S | S | S | S | S | S | S | S |

| | | | | | | | | | | |
|---|---|---|---|---|---|---|---|---|---|---|
| T | B | T | S | S | S | S | S | S | S | S |
| T | B | T | S | S | S | S | S | S | S | S |
| T | B | T | S | S | S | S | S | S | S | S |
| T | B | T | S | S | S | S | S | S | S | S |

| | | | | | | | | | | |
|---|---|---|---|---|---|---|---|---|---|---|
| S | S | S | S | S | S | S | S | T | B | T |
| S | S | S | S | S | S | S | S | T | B | T |
| S | S | S | S | S | S | S | S | T | B | T |
| S | S | S | S | S | S | S | S | T | B | T |

| | | | | | | | | | | |
|---|---|---|---|---|---|---|---|---|---|---|
| | | | T | B | T | S | S | S | S | S |
| | | | T | B | T | S | S | S | S | S |
| | | | T | B | T | S | S | S | S | S |
| | | | T | B | T | S | S | S | S | S |

| | | | | | | | | | | |
|---|---|---|---|---|---|---|---|---|---|---|
| S | S | S | S | S | T | B | T | | | |
| S | S | S | S | S | T | B | T | | | |
| S | S | S | S | S | T | B | T | | | |
| S | S | S | S | S | T | B | T | | | |

| | | | | | | | | | | |
|---|---|---|---|---|---|---|---|---|---|---|
| | | | | | | T | B | T | S | S |
| | | | | | | T | B | T | S | S |
| | | | | | | T | B | T | S | S |
| | | | | | | T | B | T | S | S |

| | | | | | | | | | | |
|---|---|---|---|---|---|---|---|---|---|---|
| S | S | T | B | T | | | | | | |
| S | S | T | B | T | | | | | | |
| S | S | T | B | T | | | | | | |
| S | S | T | B | T | | | | | | |

| | | | | | | | | | | |
|---|---|---|---|---|---|---|---|---|---|---|
| S | S | S | S | S | S | S | S | S | S | S |
| | | | | | | T | B | T | S | S |
| | | | | | | T | B | T | S | S |
| | | | | | | T | B | T | S | S |

| | | | | | | | | | | |
|---|---|---|---|---|---|---|---|---|---|---|
| S | S | S | S | S | S | S | S | S | S | S |
| S | S | T | B | T | | | | | | |
| S | S | T | B | T | | | | | | |
| S | S | T | B | T | | | | | | |

| | | | | | | | | | | |
|---|---|---|---|---|---|---|---|---|---|---|
| | | | T | B | T | S | S | S | S | S |
| | | | T | B | T | S | S | S | S | S |
| | | | T | B | T | S | S | S | S | S |
| | | | T | B | T | S | S | S | S | S |

| | | | | | | | | | | |
|---|---|---|---|---|---|---|---|---|---|---|
| S | S | S | S | S | T | B | T | | | |
| S | S | S | S | S | T | B | T | | | |
| S | S | S | S | S | T | B | T | | | |
| S | S | S | S | S | T | B | T | | | |

| | | | | | | | | | | | |
|---|---|---|---|---|---|---|---|---|---|---|---|
| 1 | T | B | T | S | S | S | S | S | S | S | S |
| 2 | T | B | T | S | S | S | S | S | S | S | S |
| 3 | T | B | T | S | S | S | S | S | S | S | S |
| 4 | T | B | T | S | S | S | S | S | S | S | S |

| | | | | | | | | | | |
|---|---|---|---|---|---|---|---|---|---|---|
| S | S | S | S | S | S | S | S | T | B | T |
| S | S | S | S | S | S | S | S | T | B | T |
| S | S | S | S | S | S | S | S | T | B | T |
| S | S | S | S | S | S | S | S | T | B | T |

Fig.7B

| | | | | | | | | | | |
|---|---|---|---|---|---|---|---|---|---|---|
| S | S | S | S | S | S | S | S | S | S | S |
| S | S | S | S | S | S | S | S | S | S | S |
| S | S | S | S | S | S | S | S | S | S | S |
| S | S | S | S | S | S | S | S | S | S | S |

| | | | | | | | | | | |
|---|---|---|---|---|---|---|---|---|---|---|
| S | S | S | S | S | S | S | S | S | S | S |
| S | S | S | S | S | S | S | S | S | S | S |
| S | S | S | S | S | S | S | S | S | S | S |
| S | S | S | S | S | S | S | S | S | S | S |

| | | | | | | | | | | |
|---|---|---|---|---|---|---|---|---|---|---|
| T | B | T | S | S | S | S | S | S | S | S |
| T | B | T | S | S | S | S | S | S | S | S |
| T | B | T | S | S | S | S | S | S | S | S |
| T | B | T | S | S | S | S | S | S | S | S |

| | | | | | | | | | | |
|---|---|---|---|---|---|---|---|---|---|---|
| S | S | S | S | S | S | S | S | T | B | T |
| S | S | S | S | S | S | S | S | T | B | T |
| S | S | S | S | S | S | S | S | T | B | T |
| S | S | S | S | S | S | S | S | T | B | T |

| | | | | | | | | | | |
|---|---|---|---|---|---|---|---|---|---|---|
| | | | T | B | T | S | S | S | S | S |
| | | | T | B | T | S | S | S | S | S |
| | | | T | B | T | S | S | S | S | S |
| | | | T | B | T | S | S | S | S | S |

| | | | | | | | | | | |
|---|---|---|---|---|---|---|---|---|---|---|
| S | S | S | S | S | T | B | T | | | |
| S | S | S | S | S | T | B | T | | | |
| S | S | S | S | S | T | B | T | | | |
| S | S | S | S | S | T | B | T | | | |

| | | | | | | | | | | |
|---|---|---|---|---|---|---|---|---|---|---|
| | | | | | | T | B | T | S | S |
| | | | | | | T | B | T | S | S |
| | | | | | | T | B | T | S | S |
| | | | | | | T | B | T | S | S |

| | | | | | | | | | | |
|---|---|---|---|---|---|---|---|---|---|---|
| S | S | T | B | T | | | | | | |
| S | S | T | B | T | | | | | | |
| S | S | T | B | T | | | | | | |
| S | S | T | B | T | | | | | | |

| | | | | | | | | | | |
|---|---|---|---|---|---|---|---|---|---|---|
| S | S | S | S | S | S | S | S | S | S | S |
| | | | | | | T | B | T | S | S |
| | | | | | | T | B | T | S | S |
| | | | | | | T | B | T | S | S |

| | | | | | | | | | | |
|---|---|---|---|---|---|---|---|---|---|---|
| S | S | S | S | S | S | S | S | S | S | S |
| S | S | T | B | T | | | | | | |
| S | S | T | B | T | | | | | | |
| S | S | T | B | T | | | | | | |

| | | | | | | | | | | |
|---|---|---|---|---|---|---|---|---|---|---|
| | | | T | B | T | S | S | S | S | S |
| | | | T | B | T | S | S | S | S | S |
| | | | T | B | T | S | S | S | S | S |
| | | | T | B | T | S | S | S | S | S |

| | | | | | | | | | | |
|---|---|---|---|---|---|---|---|---|---|---|
| S | S | S | S | S | T | B | T | | | |
| S | S | S | S | S | T | B | T | | | |
| S | S | S | S | S | T | B | T | | | |
| S | S | S | S | S | T | B | T | | | |

| | | | | | | | | | | |
|---|---|---|---|---|---|---|---|---|---|---|
| T | B | T | S | S | S | S | S | S | S | S |
| T | B | T | S | S | S | S | S | S | S | S |
| T | B | T | S | S | S | S | S | S | S | S |
| T | B | T | S | S | S | S | S | S | S | S |

| | | | | | | | | | | |
|---|---|---|---|---|---|---|---|---|---|---|
| S | S | S | S | S | S | S | S | T | B | T |
| S | S | S | S | S | S | S | S | T | B | T |
| S | S | S | S | S | S | S | S | T | B | T |
| S | S | S | S | S | S | S | S | T | B | T |

| | | | | | | | | | | | |
|---|---|---|---|---|---|---|---|---|---|---|---|
| 1 | S | S | S | S | S | S | S | S | S | S | S |
| 2 | S | S | S | S | S | S | S | S | S | S | S |
| 3 | S | S | S | S | S | S | S | S | S | S | S |
| 4 | S | S | S | S | S | S | S | S | S | S | S |

| | | | | | | | | | | |
|---|---|---|---|---|---|---|---|---|---|---|
| S | S | S | S | S | S | S | S | S | S | S |
| S | S | S | S | S | S | S | S | S | S | S |
| S | S | S | S | S | S | S | S | S | S | S |
| S | S | S | S | S | S | S | S | S | S | S |

METHOD FOR PRODUCING A KNITTED ARTICLE, AND ARTICLE THUS PRODUCED

TECHNICAL FIELD

The present invention relates to improvements the methods for producing articles or garments comprising two leg pieces and a body, for instance pantyhose, tights or the like. Especially, the present invention relates to methods for producing seamless garments of the above mentioned type using a single knitting process onto a circular knitting machine provided with single or double needle bed.

STATE OF THE ART

In the field of the production of tights, pantyhose and similar knitted articles, there is a continuous search for new methods and systems for automating the knitting process, to obtain a seamless continuous article or garment, knitted on a circular machine in a single production process.

Some searches are based on a process developed in the '60s. According to said process, a tubular article is knitted during a single process onto a circular knitting machine starting from an end of a first leg piece up to an end of a second leg piece, knitting three subsequent tubular portions or sections to form, in addition to the two leg pieces, the body of the article. The tubular article unloaded form the circular knitting machine is then cut in the central area to form an opening around which an elastic edge is sewn to form the body waist. This known process is disclosed in GB-1235361. To increase its fit, the body is knitted with wider stitches, so that the central portion of the tubular article or garment has a slightly greater section than the section of the leg pieces.

The method disclosed in GB-1235361 is very fast as it could be performed on a circular knitting machine with continuous motion. However, the article produced by means of this method had low success as the body, being formed with a tubular fabric with the same number of stitches per course as the tubular legs, did not fit sufficiently closely. More in particular, the body height was too limited and the elastic edge was too close to the crotch line.

Many improvements to this method have been investigated, aimed at overcoming the limits and drawbacks thereof.

U.S. Pat. No. 2,962,884 discloses a method wherein, after having knitted the first leg piece and before knitting the second leg piece, two pockets of fabric are produced on the circular knitting machine by knitting with reciprocating motion courses of gradually decreasing and then increasingly length. In addition to the two pockets, also an intermediate area or portion is formed with reciprocating motion. The two pockets and the intermediate portion knitted with reciprocating motion form the body of the garment, which is thus significantly higher than the body manufactured with the method originally described in GB-1235361.

However, the method disclosed in U.S. Pat. No. 2,962,884 is particularly slow as most garment is knitted with reciprocating motion. In spite of this inconvenience, at the present time seamless tights are produced using this method. Especially, the seamless tights of the Austrian company Wolford are manufactured with this method, combining continuous motion for knitting the leg pieces and reciprocating motion for knitting the body.

U.S. Pat. No. 4,022,035 describes a method for producing tights in a single process on a circular knitting machine with a technique similar to that of U.S. Pat. No. 2,962,884. In this further embodiment, while knitting the central body portion with reciprocating motion a suitable needles selection is provided so as to form the opening of the garment directly onto the circular machine. This process is still particularly slow, as it is mostly made with reciprocating motion of the needle cylinder.

A need therefore exists to further improve the methods for knitting pantyhose, tights and similar articles or garments having a body and two leg pieces, using a single process onto a circular knitting machine, that overcome or reduce the drawbacks of the known methods that are still used.

SUMMARY OF THE INVENTION

To produce faster and more effectively an article or garment that gives a snug fit a method is substantially provided, wherein the body is knitted with continuous motion of the needle cylinder, forming two side pockets of fabric, i.e. pockets arranged on the sides of the article or garment, gradually reducing and then increasing the number of stitches in each course. As the cylinder moves with continuous motion, when each partial course has been formed the yarns are cut, both while forming decreases and while forming increases. The ends of the yarns are anchored to the fabric, thus avoiding a run is produced in the article, by means of the stitches formed by the working needles. The formation of the pockets of fabric on the garment sides and of the intermediate or central part of the body with continuous motion and not with intermittent motion of the needle cylinder allows to produce a snug-fit article in short times.

Practically, according to advantageous embodiments, a method is provided for producing a knitted article or garment with two leg pieces and one body on a circular knitting machine with at least one circular needle bed, the method comprising the following steps:

- knitting a first tubular leg piece with continuous motion;
- knitting a first pocket of fabric with continuous motion, starting from an end course of the first leg piece, the first pocket forming a first side part of the body;
- knitting a central part of the body with continuous motion;
- knitting a second pocket of fabric with continuous motion starting from the central part of the body up to a start course of a second tubular leg piece;
- knitting the second tubular leg piece with continuous motion starting from the start course.

In some embodiments, an opening is formed in the fabric while knitting at least one part of the body; in the finished product, this opening will be the opening to wear the article. Around this opening a finishing elastic edge may be advantageously applied once the article has been removed from the circular knitting machine where it has been produced.

In advantageous embodiments all the knitting steps are performed with the same number of feeds, i.e. with the same number of working yarns. The number of feeds is preferably greater than two, so that the knitting process is faster, thanks to the fact that every time the needle cylinder rotates a number of courses is formed equal to the number of feeds. In advantageous embodiments the number of feeds is even, for instance two feeds. In some embodiments the use of four feeds allows to achieve higher production speeds.

Advantageously, so-called S- and Z-yarns may be used, for instance two S-yarns and two Z-yarns arranged preferably alternately.

According to a further aspect, a method is provided for manufacturing a knitted article with two leg pieces and one body on a circular knitting machine with at least one circular needle bed, the method comprising the following steps:

knitting a first leg piece with continuous motion;

knitting a first pocket of fabric with continuous motion, starting from an end course of the first leg piece, the first pocket forming a first side part of the body and comprising a first sequence of partial courses of gradually decreasing length and a second sequence of partial courses of gradually increasing length, wherein the yarn forming each partial course is cut at the end of the respective partial course;

knitting a central part of said body with continuous motion;

knitting a second pocket of fabric with continuous motion, starting from the central part of the body up to a start course of a second leg piece, the second pocket forming a second side part of the body and comprising a third sequence of partial courses of gradually decreasing length and a fourth sequence of partial courses of gradually increasing length, wherein the yarn forming each partial course of the third sequence and of the fourth sequence is cut at the end of the respective partial course;

knitting said second leg piece with continuous motion starting from the start course up to the toe.

According to a further aspect, a knitted article or garment is provided with a body and two tubular leg pieces, wherein the body comprises a central part and two side pockets of knitted fabric. Each pocket is formed by a first series of partial courses—that are extension of a knitted fabric forming the two tubular leg pieces and have a decreasing length starting from a complete end course of the respective tubular leg piece up to a partial course of minimal length of the respective pocket—and by a second series of partial course—that are extension of the fabric forming the central part of the body and have an increasing length starting from the respective partial course of minimal length up to a respective complete course of the body central part. Advantageously, the partial courses of the pockets of fabric are formed by yarns cut in correspondence of the ends of each partial course. This is the result of knitting the partial courses with continuous motion: when each partial course has been completed the respective yarn is cut to allow the cylinder of the knitting machine to continue its rotary motion without the need for stopping and reversing its motion, as instead occurs in the systems according to the current art. Advantageously, also the central part of the body is produced with continuous motion, and it is therefore formed by annular courses of stitches.

Further features and embodiments will be described below with reference to embodiments of the inventions, and in the attached claims, that form an integral part of the present description.

BRIEF DESCRIPTION OF THE DRAWINGS

The invention will be better understood by following the description and accompanying drawing, which shows non-limiting practical embodiments of the invention. More in particular, in the drawing:

FIG. 1 is a schematic front view of a portion of a knitted article or garment produced with the method according to the invention;

FIG. 2 is a perspective view of the garment of FIG. 1;

FIGS. 3A, 3B-7A, 7B show the area of formation of the decreased and increased courses along one of the two pockets of fabric forming the side areas of the body, and the corresponding control of the needles;

DETAILED DESCRIPTION OF EMBODIMENTS OF THE INVENTION

The following detailed description of exemplary embodiments is made with reference to the attached drawings. The same reference numbers in different drawings identify equal or similar elements. Furthermore, the drawings are not necessarily to scale. The detailed description below does not limit the invention. The scope of protection of the present invention is defined by the attached claims.

In the description, the reference to "an embodiment" or "the embodiment" or "some embodiments" means that a particular feature, structure or element described with reference to an embodiment is comprised in at least one embodiment of the described subject matter. The sentences "in an embodiment" or "in the embodiment" or "in some embodiments" in the description do not therefore necessarily refer to the same embodiment or embodiments. The particular features, structures or elements can be furthermore combined in any adequate way in one or more embodiments.

FIG. 1 schematically shows a flattened front view of an article or garment produced according to the method described below. FIG. 2 is a perspective view of the same article or garment.

Figure 11:
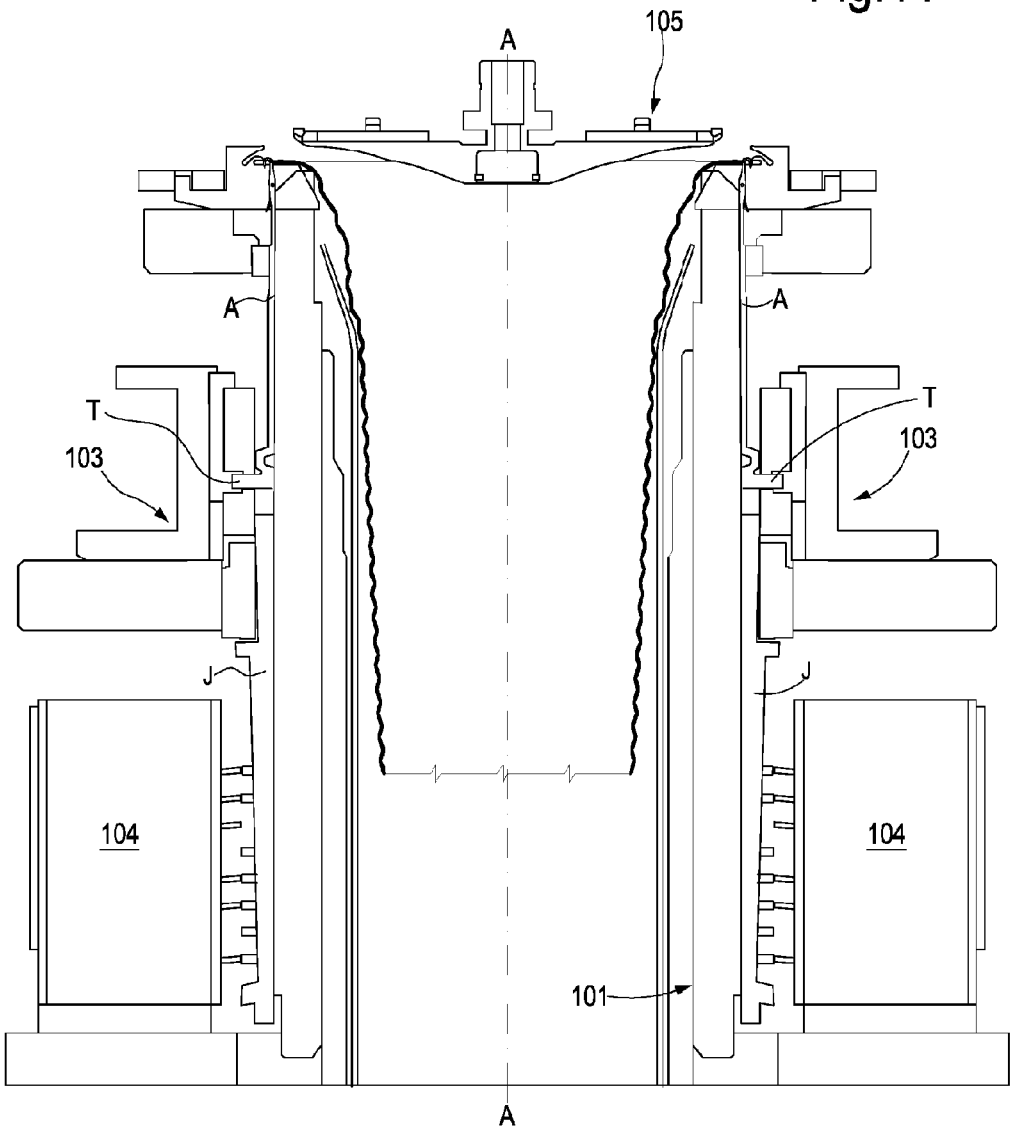
FIG. 11 is a schematic longitudinal cross-section of a knitting machine with which the method described herein can be performed.

FIG. 11 schematically shows a knitting machine with which an article or garment can be knitted according to the method described herein. As well known, the machine comprises a cylinder 101 provided with a needle bed A and, as the case may be, jacks J arranged below each needle. The cylinder 101 moves with continuous rotary motion around its own axis A-A so that the needles knit the article by means of yarns fed from one or more feeds, not shown. The movement of the needles is controlled by means of cams 103, selectors 105 and any other members necessary for controlling the needles. The needle actuating and controlling members are preferably stationary, i.e. they do not rotate around the axis A-A of the needle cylinder 101. A dial 105 may be associated with the needle cylinder 101. In other embodiments, as it is well known, the machine may comprise two superimposed needle cylinders. The details of the knitting machines usable for knitting garments of the type described herein are well known to those skilled in the art and do not require further explanations. Vice versa, the method of the present invention is novel with respect to those currently performed with the circular knitting machines for manufacturing articles or garments with a body and two leg pieces. The knitting steps of this novel method will be detailed below.

In some embodiments the garment or article, indicated as a whole with number 1, comprises a first tubular leg piece 3 and a second tubular leg piece 5. Each of the two tubular leg pieces 3 and 5 extends from a respective toe or end (not shown), that can be open or closed, up to an upper body indicated with 7. The tubular leg pieces may extend up to ends forming respective feet of the article, for instance in the case of tights or pantyhose. In other embodiments the tubular leg pieces 3 and 5 may be shorter and can comprise even few courses of stitches so as to form, together with the body 7, a sort of knickers.

The body 7 has an opening 9 surrounded by a finishing edge indicated with 11, preferably an elastic edge. The elastic edge 11 is shown in FIG. 2, while FIG. 1 shows an article or garment, not yet completed, and in particular an article before the edge 11 has been applied thereto. It has only an opening 13 in the upper part of the body 7, along the edges of which the edge 11 is subsequently sewn.

In advantageous embodiments the body 7 comprises three portions: a central portion 15 and two side portions 17 and 19. As it will be better detailed below, each of the side portions 17 and 19 comprises at least one respective pocket of fabric. Each pocket of fabric comprises partial courses of stitches with gradually decreasing and increasing lengths produced with continuous motion of the needle cylinder; the central portion 15 of the body is also produced with continuous rather than with reciprocating motion of the needle cylinder, and this results in a greater productivity with respect to the currently used methods. It is therefore possible, in a short time interval, to knit an article having, on its sides, pockets of fabric that increase the fit of the article. Thanks to these pockets of fabric the elasticity of the central body portion is not limited and the article or garment can therefore be used also by people wearing relatively large sizes.

In some embodiments the article or garment 1 is produced with a single knitting operation on a circular machine, for instance a single-cylinder circular machine with dial, as the case may be. A double-cylinder machine can also be used.

The knitting process is substantially comprised of a sequence of steps, at the end of which a complete article with body and tubular leg pieces is produced. More in particular, the knitting process may be for instance subdivided into seven consecutive steps, as it will be explained below.

The knitting process can indifferently start from the tubular leg piece 3 or from the tubular leg piece 5. For the sake of practicality of the description, reference will be made below to a process starting by knitting the tubular leg piece 3 and ending by knitting the tubular leg piece 5, being however understood that the process can be reversed, starting by knitting the tubular leg piece 5 and ending by knitting the tubular leg piece 3.

In a first knitting step on the known circular knitting machine (not shown), the tubular leg piece 3 is knitted with usual continuous motion, wherein the needle control cams remains preferably stationary and the needle cylinder rotates around its own axis with continuous motion. For knitting the tubular leg piece 3 it is possible to use all the needles or select them to produce particular effects. However, as the leg piece has a tubular extension, courses of stitches are generally formed that, at least partially, extend for all the circumference of the needle bed.

For knitting the tubular leg piece 3 the needle bed can be fed with one or more feeds. At least two feeds are preferably used and more in general an even number of feeds. In this way, if coated or spiral yarns are used, it is possible to use an equal number of Z-yarns and S-yarns, i.e. for instance yarns with an elastomer core coated by filaments wound clockwise or counterclockwise. As well known to those skilled in the art, the use of Z-yarns and S-yarns at the same time allows a better consistency of the article, that does not tend to twist. Furthermore, the use of more than one feed allows a faster production, as at every complete revolution of the needle cylinder a number of courses is generally formed equal to the number of working feeds. In preferred embodiments four feeds are used, so that at every revolution of the cylinder four consecutive courses of stitches are formed.

The knitting of the tubular leg piece 3 ends with the formation of a last circular c, i.e. a last circular course of stitches, indicated with 23. The complete course 23 is preferably comprised of a number of stitches equal to the number of needles with which the circular knitting machine is provided, even if this is not compulsory. The only important thing is that this course is closed onto itself.

Courses of stitches extending horizontally, indicated with RG3 in FIG. 1, are therefore formed along the tubular leg piece 3. The stitches forming the courses RG3 are arranged according to substantially longitudinal columns of stitches along the extension of the tubular leg piece 3, as shown with CG3 in FIG. 2.

A second step of the process is then performed on the circular knitting machine; this step consists of knitting with continuous motion a first series of partial courses of gradually decreasing length to form a first portion 17D of the pocket 17 of fabric. Below will be described in greater detail, with reference to FIGS. from 3A to 9, how this portion of pocket and the remaining portion of the pockets 17, 19 are formed with continuous motion.

While the portion 17D of the pocket 17 is being formed, partial courses of stitches are sequentially knitted, whose length gradually decreases starting from the complete course 23 up to a course RM17 of minimal length, ending this second step of the knitting process. The course RM17 extends from one end point to the other, both indicated with C1, of two opposite lines L17. Actually, as a plurality of feeds are used for knitting, the number of partial courses RM17 of minimal length will be preferably greater than one and equal to the number of feeds used, for instance four.

The ends of the partial courses following one another along the portion 17D of the pocket 17 are arranged according to the two opposite delimiting lines L17 which extend inclined (one on the front and the other on the back of the garment) from the course 23 up to the course RM17. It must be understood that, even if not shown in the drawing, in the area of the pocket 17 there are actually two substantially mirror-like lines L17, one on the front and the other on the back. These opposite lines L17 are constituted by the alignment of the ends of the partial courses formed in this step of the knitting process. Each partial course ends with a cut yarn. Therefore along the lines L17 the cut ends of the yarns forming the partial courses of the portion 17D of the pocket 17 of fabric are arranged. As the pocket 17 is knitted with continuous and not with reciprocating motion of the needle cylinder, cutting the yarns at the end of each formed partial course is required.

Also the portion 17D of the pocket 17 may be knitted by means of a plurality of feeds. Preferably, a number of feeds is used equal to the number of feeds used for knitting the first tubular leg piece 3, therefore preferably four feeds. The portion 17D of the pocket of fabric may be formed by the same yarns used for knitting the tubular leg piece 3 or by different yarns, for instance yarns of different count, composition or structure. In some embodiments the type of yarn may be changed in an intermediate step while knitting the portion 17D of the pocket 17.

In general, while knitting the portion 17D of the pocket 17 groups of courses of equal length are produced, said length decreasing from one group of courses to the subsequent group. Each group of courses contains preferably a number of courses equal to the number of feeds with which the needles of the knitting machine are fed.

Once this portion 17D of the pocket 17 has been completely formed, the subsequent step starts of knitting a second portion, indicated with 17C, of the pocket 17. The portion 17C of the pocket 17 is knitted with continuous motion of the needle cylinder and with gradual increase, i.e. with a gradual increase in the length of the courses following one another while knitting this portion 17C of the pocket 17. Also the portion 17C of the pocket 17 may be formed feeding the cylinder, which is rotating with continuous motion, with yarns from a plurality of feeds, preferably four feeds. Therefore, as described above with reference to the formation of courses of decreasing length forming the portion 17D of the pocket 17, while forming the portion 17C of the pocket 17 it is actually possible to form groups of courses, each of which comprises a number of courses equal to the number of feeds, wherein the courses of each group have the same length, i.e. are formed by the same number of stitches, while this number increases gradually from a group to the subsequent group of courses.

The various partial courses formed during the third step of the knitting process for forming the portion 17C of the pocket 17 join at their ends the partial courses of decreasing length forming the portion 17D. The decreasing partial courses and the increasing partial courses join together along the line L17 as it will be better described below with reference to the subsequent figures.

The knitting of the portion 17C of the pocket 17 continues with gradual increase in the length of the single courses up to the formation of the last course of the portion 17C, that is indicated with 25 and is a complete course, i.e. having an annular extension and formed preferably with a number of stitches equal to the overall number of needles of the machine. The formation of this complete course 25 concludes the third knitting step of the garment or article 1. Actually, as a plurality of feeds is preferably used, the knitting of the portion 17C of the pocket 17 actually ends with the formation, in one single revolution of the needle cylinder, of a number of complete courses equal to the number of feeds used.

The subsequent step of the production process is the formation of the central portion 15 of the body 7. This central portion is knitted maintaining the continuous motion of the needle cylinder, the needles forming a sequence of complete courses with annular extension substantially parallel to the course 25. The formation of a last complete course 27 concludes the knitting of the central portion 15 of the body 7.

As shown in particular in FIG. 2, in the portion 17C of the pocket 17 and in the central portion 15 of the body 7 the stitches of the formed fabric are arranged according to columns substantially parallel to the edge 11 defining the opening through which the garment or article 1 is worn. Accordingly, the courses of stitches are substantially orthogonal to the columns.

In the subsequent knitting step two portions 19D and 19C of the pocket 19 are formed, with a process that substantially reflects that used for forming the pocket 17.

More in particular, the fifth step of the knitting process comprises the formation of a series of partial courses of gradually decreasing length with continuous motion of the needle cylinder, starting from the course 27 completing the central portion 15 of the body 7. The partial courses forming the portion 19D of the pocket 19 have ends arranged along two lines L19, only one of which is shown in the drawing and the other one is the mirror of this. The lines L19 are equivalent to the lines L17.

Along the lines L19 the ends of the yarns are fixed, which form the partial courses defining the portion 19D of the pocket 19 and that are cut while these partial courses are being formed, to allow the continuous rotation of the needle cylinder.

The formation of a partial course of minimal length indicated with RM19 concludes the fifth step of the knitting process; this partial course RM19 extends from one to the other end point C2 of the two opposite lines L19.

After this fifth knitting step, the sixth knitting step starts, consisting in the formation of the second portion 19C of the pocket 19. In this sixth step partial courses of increasingly great length are formed starting from the course RM19 of minimal length up to an annular complete course 29 formed preferably by a number of stitches equal to the number of needles with which the machine is provided. This course 29 is the last course of fabric of the pocket 19 and the first course of the tubular leg piece 5.

In fact, now the seventh and last step for knitting the garment 1 starts, with the formation of continuous courses RG5 starting from the start course 29 of the tubular leg piece 5 up to the last course of the end thereof (not shown).

Symmetrically to what has been described with reference to the pocket 17 and the tubular leg piece 3, along the portion 19D of the pocket 19 the columns CC of stitches are arranged substantially parallel to the edge 11, while along the portion 19C and along the leg piece 5 the columns are arranged according to the longitudinal extension of the tubular leg piece 5 as schematically shown by lines CGS.

A more detailed description of the process for forming the pockets 17, 19 of fabric with continuous motion will be described below with reference to the sequence of FIGS. 3A, 3B-7A, 7B. It should be noted that what described below refers to a particular case, wherein the machine used for forming the garment or article 1 has four feeds. This is the currently preferred number of feeds for knitting the garment or article 1. From this exemplary disclosure those skilled in the art can understand how it is possible to produce an article or garment using a different number of feeds.

With reference to FIGS. 3A-7A and 3B-7B, reference will be made below to the step of knitting the pocket 17 that (as briefly described above) starts with the formation of a portion 17D of gradually decreasing courses, i.e. with an area of course length decrease, followed by the knitting of the area 17C with gradual increase in the length of the partial courses. From the description of these two steps of the knitting process it is easy to understand how the pocket 19 is knitted in a corresponding way.

Below a process will be described, wherein the length of the partial courses decreases in a uniform and linear manner, i.e. at every revolution of the needle cylinder there is an equal reduction in the length of the courses, said length being understood as the number of stitches forming the single course. Those skilled in the art will understand that this mode of operation is only one of the possibilities of the method described herein. In fact, the sequence of decreases and increases, i.e. of courses of gradually decreasing and increasing length, may be different than that described herein. The pattern of decreases and increases in the two pockets 17 and 19 will be preferably mirror-like, but the sequence does not necessarily need to be equal for the front and the rear part of the garment. This means that subsequent courses of different lengths may be decreased or increased in length in a different manner on the two parts (front and rear) of the fabric.

Furthermore, it is not necessary for each pocket to be provided with a single series of courses of decreasing length and a single corresponding series of courses of increasing length. On the contrary, when knitting the pockets 17 and 19 it is possible to perform increasing and decreasing courses in multiple sequences. Important is only that each pocket of fabric starts and ends with respective circular courses and has at least one sequence of decreasing courses and one corresponding sequence of increasing courses.

FIGS. 3A-7A show the end areas of the knitted fabric in correspondence of the two opposite lines L17 that are formed in during the knitting of the portion 17D of the pocket 17. The process described below is repeated for forming the pocket 19.

Along the area illustrated in FIGS. 3A-7A the ends of the stitch courses are arranged. In FIGS. 3A-7A the central area of the fabric has been removed, as shown by the central interruption I, so that only the two end areas of the partial courses are shown. FIGS. 3B-7B schematically show the control given to the needles to produce the fabric represented in FIGS. 3A-7A. According to a known formalism, in these figures the letters S, T, and B indicate the positions taken by the needles of the circular needle bed in the subsequent revolutions of the needle cylinder. S indicates that the respective needle is brought in cast-off position, i.e. it removes the formed stitch and prepares to catch the yarn at the following revolution. T indicates that the corresponding needle is brought into held position, wherein it holds the engaged yarn and stops stitch-forming, while B indicates that the corresponding needle is brought in low position, does not engage the yarn and does not form stitches.

Figure 3A:
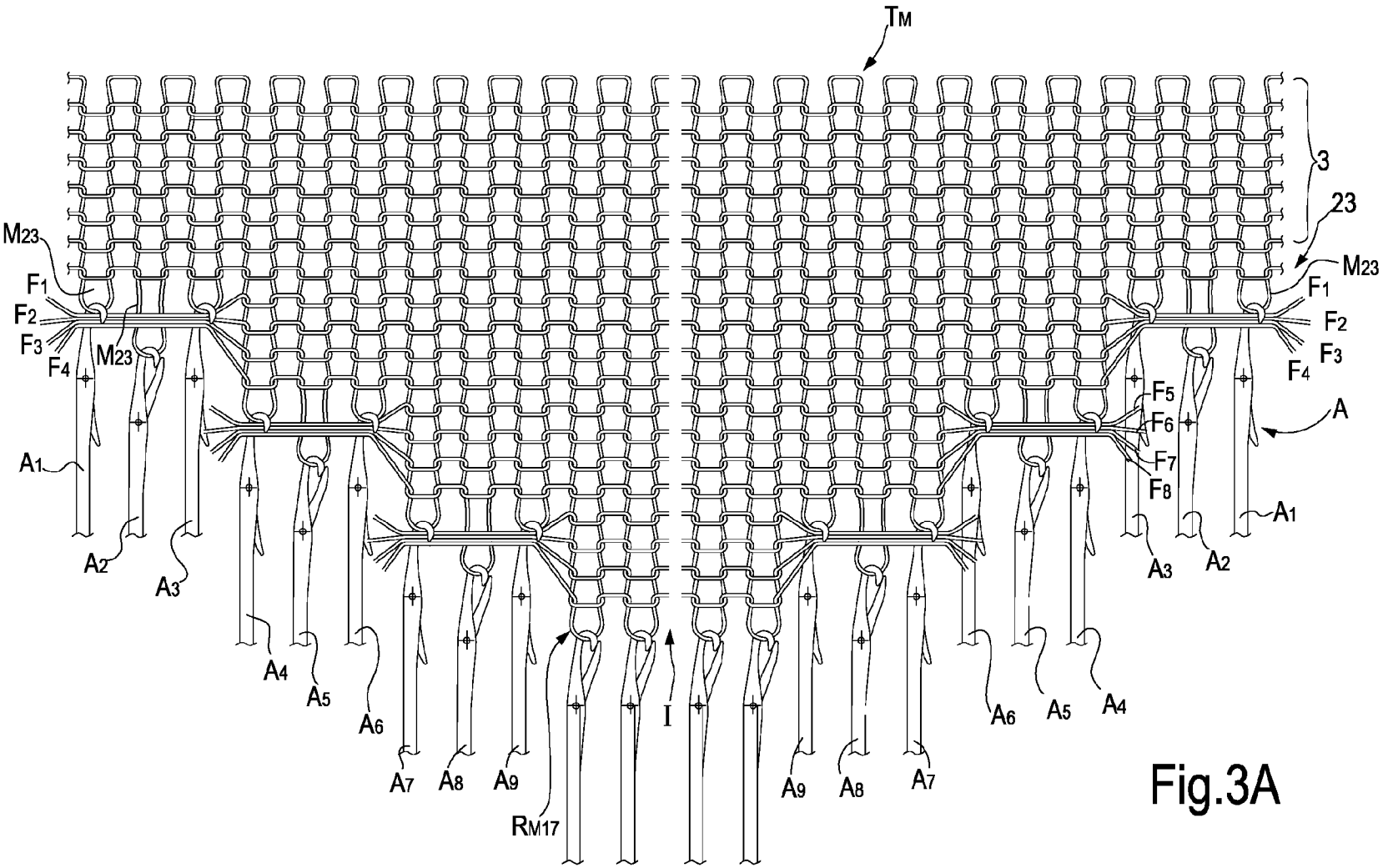

FIG. 3A illustrates the last complete course 23 defining the end of the first knitting step for forming the first tubular leg piece 3. The course 23 is formed using all the needles A with which the needle cylinder of the machine is provided. It should be understood that in FIG. 3A, as well as in the remaining figures, the fabric is shown on a plane; furthermore, the cut ends of the stitches represented on the right side of each figure are intended as linked to the corresponding ends of the stitches on the left side.

The knitting of the last course 23 and of the previous courses, indicated as a whole with 3 in FIG. 3A-7A, occurs traditionally with continuous rotation of the needle cylinder.

With reference to FIG. 3A, the revolution following the revolution that has formed the last course 23 produces a number of partial courses equal to the number of feeds of the machine, that are four in the illustrated example. These four courses are shorter (i.e. they are formed by a smaller number of stitches) than the course 23. F1, F2, F3 and F4 indicate the four yarns of the four feeds forming these first four partial courses. As the needle cylinder has a continuous rotary movement, the yarns F1-F4 are cut at the beginning and at the end of the respective four courses of stitches that they form. At the ends of the four courses formed by the yarns F1-F4, the ends of these yarns are held by means of groups of end needles, adequately selected and moved for this purpose.

In the illustrated example, the partial courses formed by the yarns F1-F4 in FIG. 3A have six stitches less than the last complete course 23. The yarns F1-F4 end at the ends of the respective partial courses in correspondence of respective groups of three needles indicated with A1, A2, and A3 for both ends of the set of four partial courses formed by the yarns F1-F4. In other embodiments, the reduction in length of the courses may occur with a different change in the number of needles, for instance leaving four, instead of three, needles out of work at each end of the partial courses. Decreasing the number of working needles by 3+3 at every revolution is particularly advantageous, as it allows on the one hand to effectively retain the cut ends of the yarns and allows, on the other hand, a sufficiently gradual decrease in the course length, so as to form quite wide pockets 17, 19 of fabric.

In some embodiments the needles A1, A2, and A3 on each end of the four partial courses formed by the yarns F1-F4 may be in retained position, as shown for the needles A1 and A3 in FIG. 3A. The needles A1, A3 are practically brought into such a position that they hold the stitches (indicated with M23) formed by them in the course 23 and hold the yarns F1-F4 fed at the subsequent rotation of the needle cylinder, without forming stitches. This position of the needles A1, A3 is called "held" position. In some embodiments also the needles A2 may be brought into held position, like the needles A1, A3.

However, in the example illustrated in FIG. 3A the intermediate needles A2 of each triad of needles A1, A2, A3 at the ends of the partial courses formed by the yarns F1-F4 are in low position. They hold the stitch M23 formed during the previous revolution and belonging to the course 23, but do not hold the yarns F1-F4 fed at the subsequent revolution, during which these yarns F1-F4 form the first four partial courses. Therefore, in correspondence of the needles A2 there are four float loops.

In the scheme of FIG. 3B the controls for the respective needles are indicated, wherein S indicates the control for transferring the needle into cast off position for forming the respective stitch, T indicates the control for transferring the respective needle into held position and B indicates the control for transferring the needle into low position.

Referring again to FIG. 3A, the subsequent complete revolution of the needle cylinder causes the formation of a new further set of four partial courses by means of yarns F5, F6, F7 and F8. The yarns F5-F8 come actually from the same feeds from which the yarns F1-F4 come; they are therefore practically constituted by different segments of the same yarn, i.e. the yarn F5 is a segment of the yarn F1 and so on.

The four courses formed by the yarns F5-F8 are shorter than the four courses formed by the yarns F1-F4, as a triad of needles A4-A6 has been brought out of work in correspondence of each of the two ends of these four courses. The needles A4 and A6 are in held position, while the needles A5 are in low position, similarly to what has already been described with reference to the triads of needles A1-A3 and for the same reasons.

At the subsequent revolution, the triads of needles A7, A8 and A9 are brought out of work at the opposite ends of the subsequent series of four partial courses. The needles A7, A9 are in held position, the needles A8 are in low position. Each needle A7-A9 holds the last stitch formed by it at the previous revolution.

This process of forming courses of gradually decreasing length continues up to the formation of the course RM17 of minimal length, schematically shown in FIG. 3A. It should be noted that actually the number of decreasing partial courses is significantly greater than that schematically illustrated in FIG. 3A just to explain the process for forming the pockets 17 and 19.

Substantially, starting from the formation of the last complete course 23 by means of the continuous rotation of the needle cylinder and the gradual exclusion of needles from work, partial courses are formed of gradually decreasing length with yarns coming from the feeds of the machine and cut in correspondence of the ends of each partial course and held by means of a suitable selection of the end needles in correspondence of each set of four gradually decreasing courses.

While the continuous rotation of the needle cylinder continues, to form the various courses of decreasing length, the needles A1-A3, A4-A6, A7-A9 that are gradually brought into held position or low position remain in this position until the portion 17D of the pocket 17 has been completely knitted and they come back to work gradually, forming the portion 17C of the pocket 17 as it will be described with reference to the subsequent FIGS. 4A-7A.

In some embodiments, once the portion 17D of the pocket 17 has been completely knitted with the formation of the last course RM17 of minimal length, a further revolution of the needle cylinder may be done, during which the yarn of a feed forms a complete circular course of stitches, while the yarns of the remaining three feeds can knit a triad of partial courses of length equal to that of the last four courses formed during the previous revolution, i.e. of length equal to the length of the course RM17.

Figure 4A:
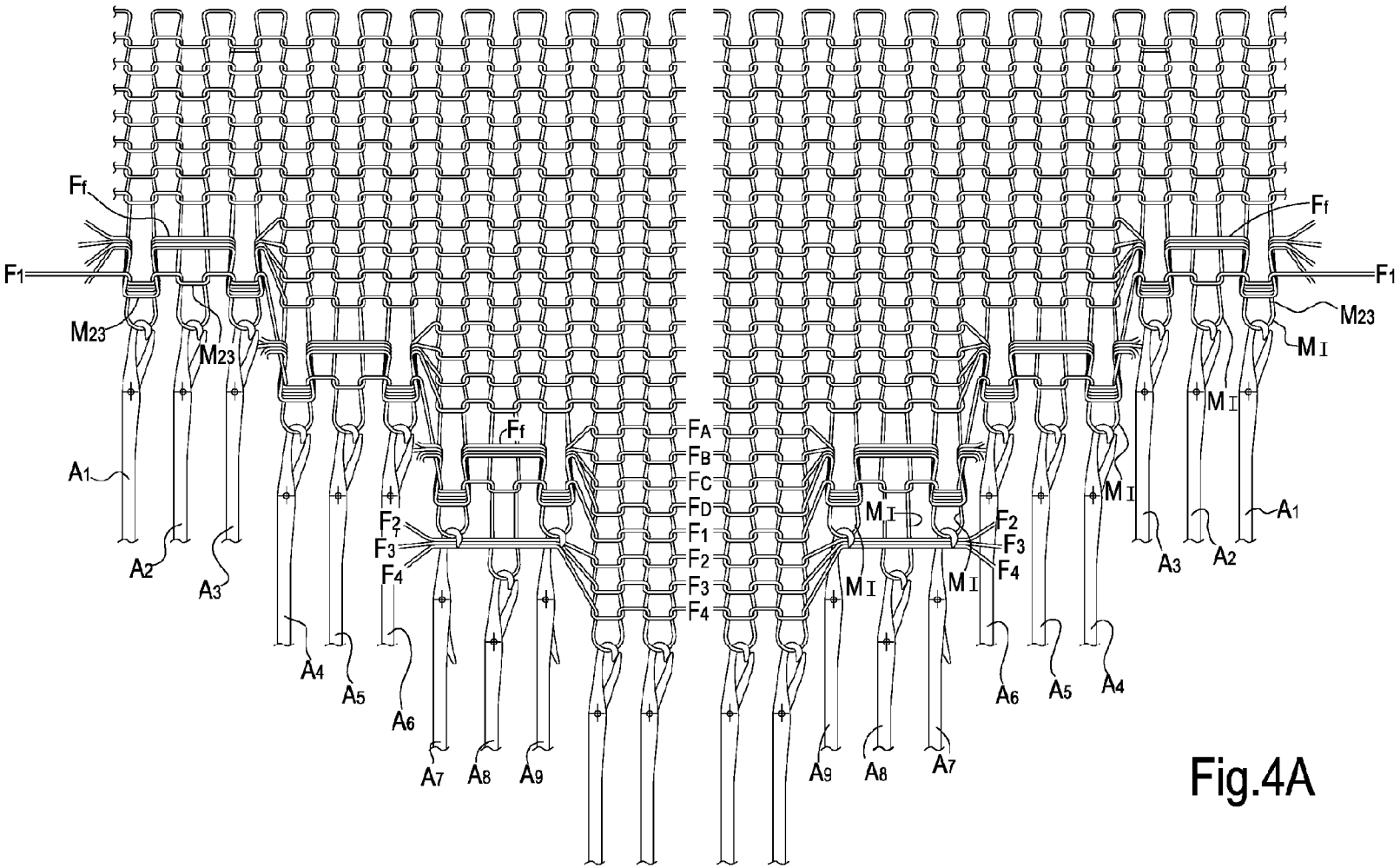

This optional step is better illustrated in FIG. 4A. In this figure F1, F2, F3 and F4 indicate again the four yarns of the four feeds forming stitches during the first revolution of the needle cylinder following the rotation that has formed the courses RM17 of minimal length. This revolution is practically an intermediate step: ending the step of knitting the portion 17D and starting the step of knitting the portion 17C. During this revolution the needles are controlled so that the yarn F1 generates a complete course of stitches, while the yarns F2-F4 form partial courses of same length as the length of courses RM17.

As shown in FIG. 4A, the yarns of three feeds (the yarns F2, F3 and F4) form three partial courses having the same length as the previous four courses, i.e. the courses formed during the previous revolution of the cylinder, while one of the four yarns, the yarn F1 in the illustrated example, is fed to all the needles of the circular bed, including the triads of needles A7-A9, A4-A6, A1-A3 on each of the two ends of the previously formed partial courses. The yarn F1 is knitted by these needles that were previously held out of work (in held or low position), forming a sequence of stitches MI forming a complete course. These stitches MI are knitted with the end stitches held by the single triads of needles that have been gradually brought out of work during the previous step of knitting the portion 17D of the pocket 17. For instance, the needles A7 and A9 of the two triads of needles that are at the ends of the four partial courses formed during the previous revolution of the cylinder have formed a respective stitch MI knitted with the four stitches formed by means of the four feeds during the previous rotation. The needle A2 has formed a stitch MI with the yarn F1 that has been knitted with the stitch formed by the same needle two revolutions before with the respect to the last revolution of the needle cylinder, and so on. The stitches M23 held by the needles A1, A2, A3 are knitted with the yarn F1 with which also the needles A1-A3 form respective stitches ML As in the illustrated example the intermediate needles of each triad (for instance needles A2, A5 and A8) have been held in low position and not in held position, in correspondence of them floated yarns Ff are formed.

S, T, and B in FIG. 4B schematically indicate the controls for lifting and lowering the needles involved in this operation.

In some embodiments the above described step of forming of a complete course can be omitted. In other embodiments it is possible to form more than just one complete course of stitches as illustrated with reference to FIG. 4A, for instance with more than one revolution of the needle cylinder, or forming a complete course with two yarns (i.e. two feeds) and not with only one.

Figure 5A:
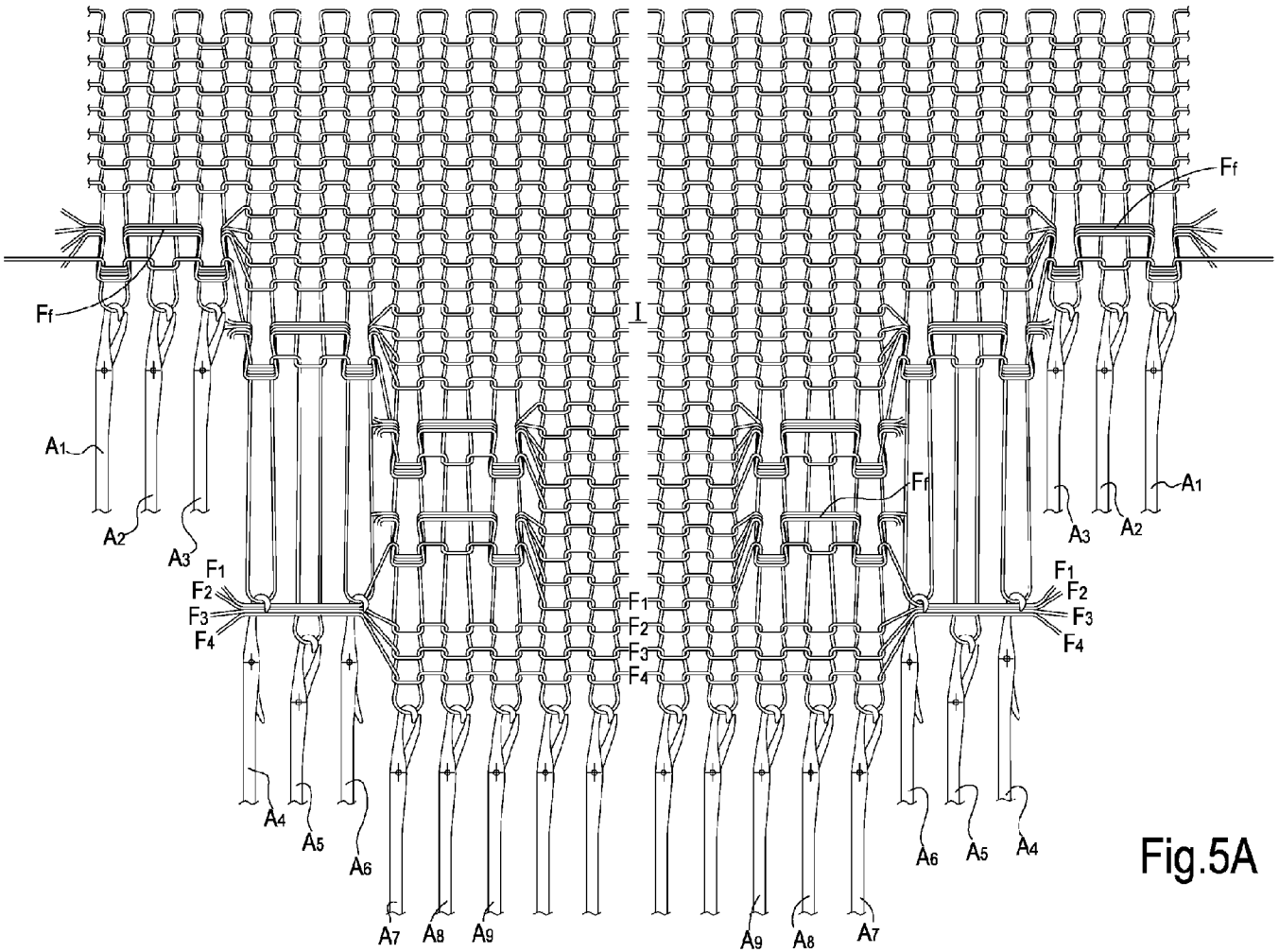

FIG. 5A shows the subsequent passage, wherein when a new revolution of the needle cylinder has been finished, the first four courses of stitches of increasing length have been formed. More in particular, the four feeds form a new set of four partial courses, that in this example have a length that is six stitches greater with respect to the length of the courses formed by the yarns F2-F4 during the previous rotation. The yarn F1 of the first feed is engaged by the needles A9, A8 and A7 knitting this yarn F1 with the stitches previously held by them. As the needles A9 and A7 are in held position, they knit the yarn F1 with four yarns held during the previous rotation. The needle A8, that is in low position, knits the yarn F1 with only one stitch. In this way the yarn F1 links with the end stitches formed by the previously formed partial courses. The yarns F2-F4 of the remaining four feeds form stitches in a similar manner. Providing, in each triad of needles that are out of work at the ends of the partial courses, a needle in low position instead of held position allows to have a knitted fabric that is thinner in correspondence of the lines L17 and L19.

Figure 6A:
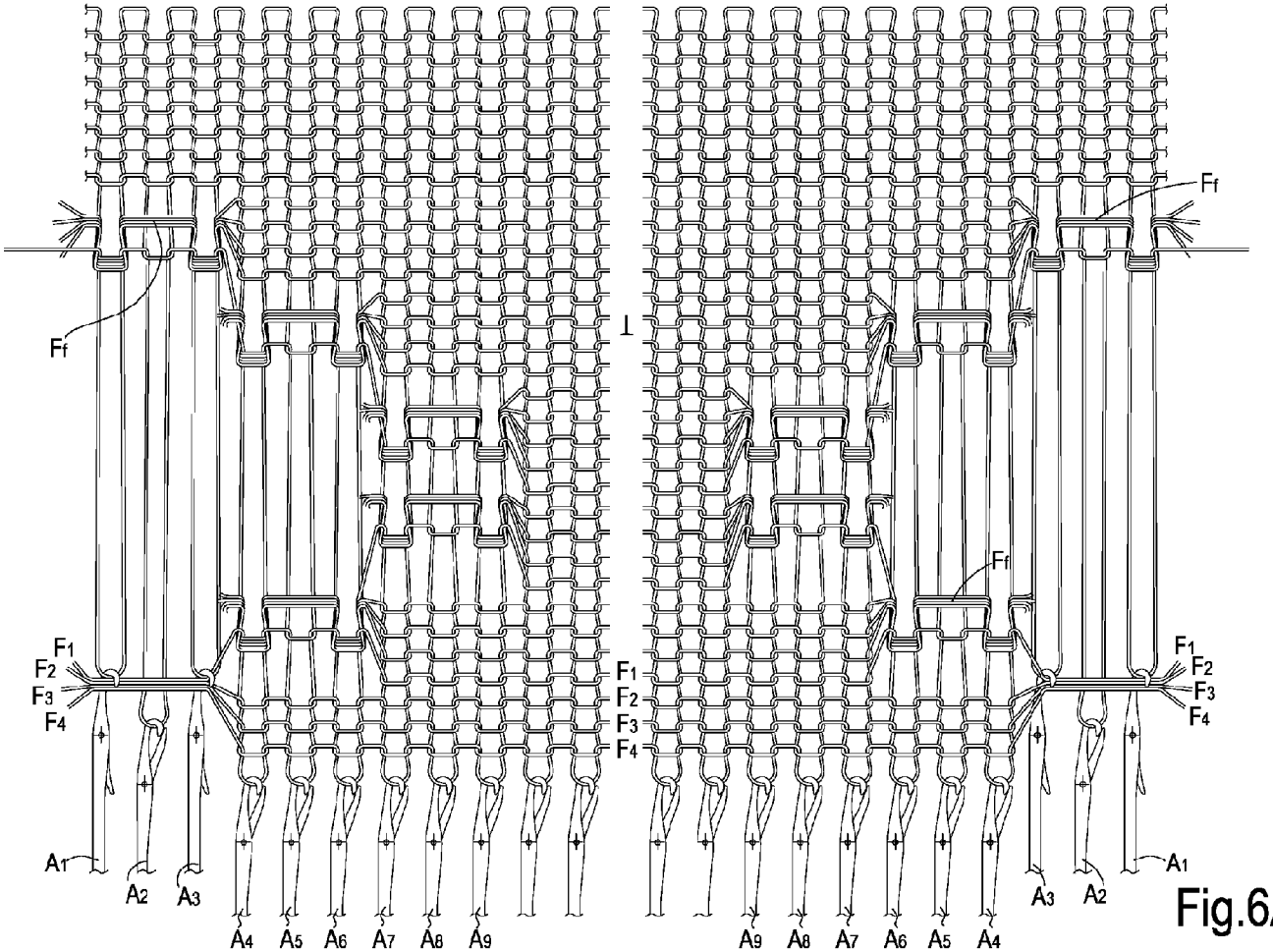
Figure 7A:
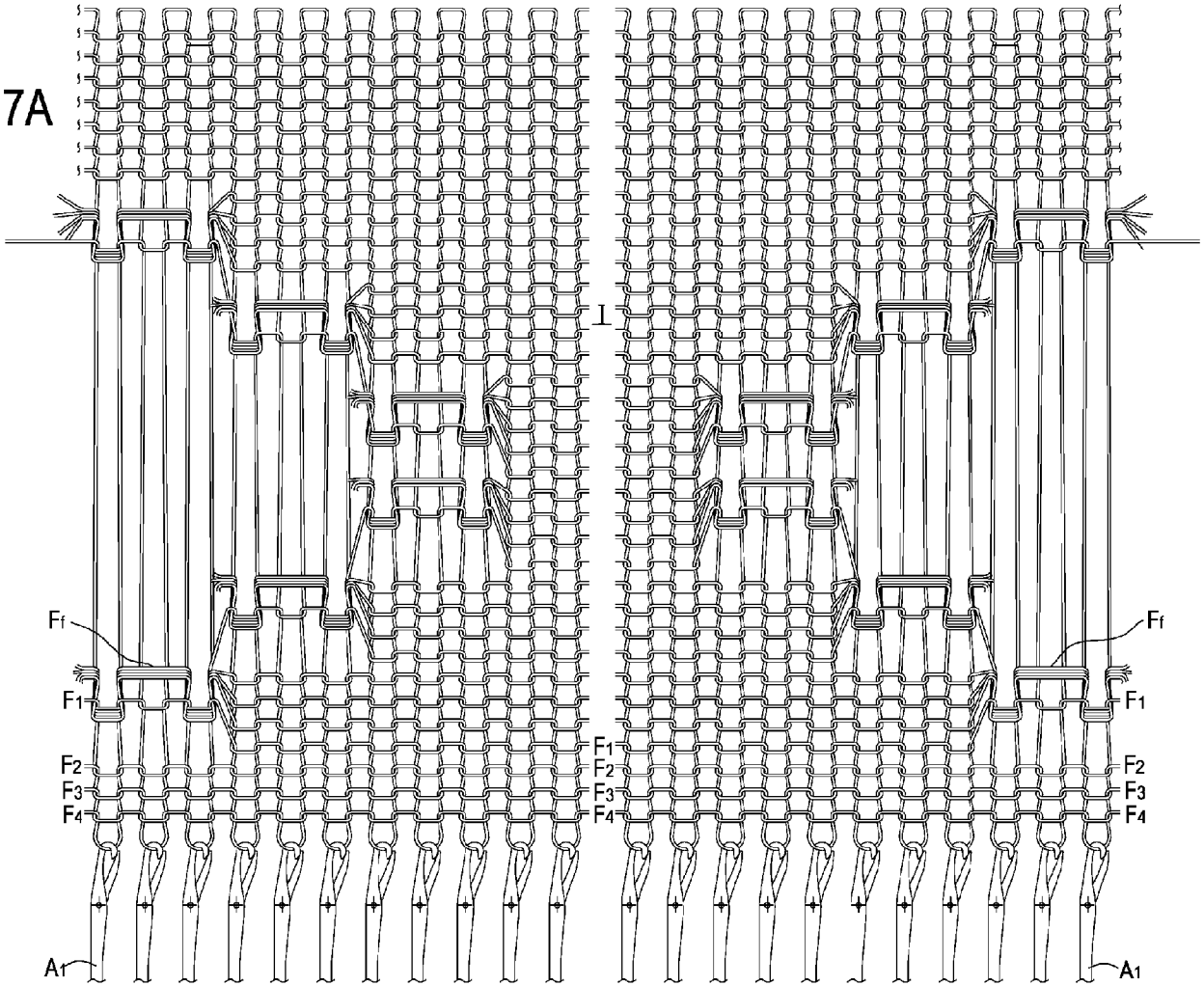

The subsequent FIGS. 6A and 7A show how, by means of subsequent revolutions of the needle cylinder, sets of four partial courses are formed, each set being formed by four yarns F1-F4 of the four feeds with which the machine is provided, of gradually increasing length. In both the figures F1-F4 indicate the yarns of the four feeds forming, the last set of four partial courses during the rotation represented in each figure.

The process continues up to have a complete course 25 constituting the last course of the portion 17C of the pocket 17 of fabric. At every subsequent revolution the formed courses join, by means of a yarn from one of the four feeds, to the stitches held by the two triads of end needles of the set of four previous courses. To each FIG. 5A-7A corresponds a homologous FIG. 5B-7B, schematically showing the controls given to the needles brought into work again, using the same symbols as above: S-cast-off needle, T-held needle, B-low needle.

From the sequence of FIGS. 3A-7A it is clearly apparent how it is possible to produce the pocket 11 with the two portions 17D of decreasing courses and 17C of increasing courses by means of the formation of a series of partial courses of gradually decreasing length and a subsequent series of partial courses of gradually increasing length, severing the yarn fed from the various feeds at the ends of each course and joining the ends of the increasing courses with the ends of the decreasing courses temporarily held by the low needles and by the held needles at the end of each partial course.

The pocket 19 of fabric is produced in a mirror-like manner, starting from the portion 19D of decreasing courses and following with the formation of the portion 19C of increasing courses. Between the formation of the pocket 17 and the formation of the pocket 19 the tubular central portion 15 of the body is generated with continuous motion of the needle cylinder.

In the embodiments described with reference to FIGS. 3A-7A; 3B-7B in the formation of decreasing and increasing partial courses, both in the formation of the pocket 17 and in the formation of the pocket 19, the number of needles kept out of work to produce decreases and then increases is six, three needles for each end of the respective courses. This means that at every step (revolution of the needle cylinder) for decreasing or increasing the number of knitted stitches per course, a triad of needles at each end of the course is brought out of work or into work. This at one hand ensures that the stitches of the partial courses do not detach and, on the other hand, allows to form wide side pockets of fabric.

In fact, thanks to the continuous rotation, at the beginning and at the end of the formation of each partial course, the respective yarn shall be cut, as shown in FIGS. 3A-7A. The ends of each yarn shall be therefore held to avoid laddering of the article or garment. This is achieved by means of the anchoring made by the stitches that, in the subsequent working step, will be formed by the three needles at the end of each partial course. For instance, the ends of the yarns indicated with $F_A$, $F_B$, $F_C$, $F_D$ in FIG. 4A are engaged by the stitches formed with the yarn F1 by the needles A7, A8, A9 at both ends of the partial courses.

The number of three needles and respective three stitches formed therebyis sufficient to retain the ends of the cut yarns. A greater number of needles brought out of work or into work at every revolution does not give significant advantages in terms of run-proof ability of the cut yarns, but it would result in a faster decrease (and subsequent increase) of the length of the partial courses, with formation of smaller pockets, that are therefore less effective from the viewpoint of improving the snug-fit of the garment or article.

In the illustrated embodiment, in each triad of needles brought temporarily out of work for making the decreases, the central needle is brought in low position (see for instance needle A2, needle A5, needle A8), while the two adjacent needles (see needles A1, A3, or needles A4, A6, or needles A7, A9) are brought in held position. As already noted, in this way float loops (Ff) are formed in correspondence of the intermediate needles of each triad. This allows to effectively anchor the ends of the cut yarns, as they are anchored by means of three stitches at each end. This also allows to lighten the fabric structure, as the intermediate needles do not form stitches with the set of four yarns.

Figure 8:
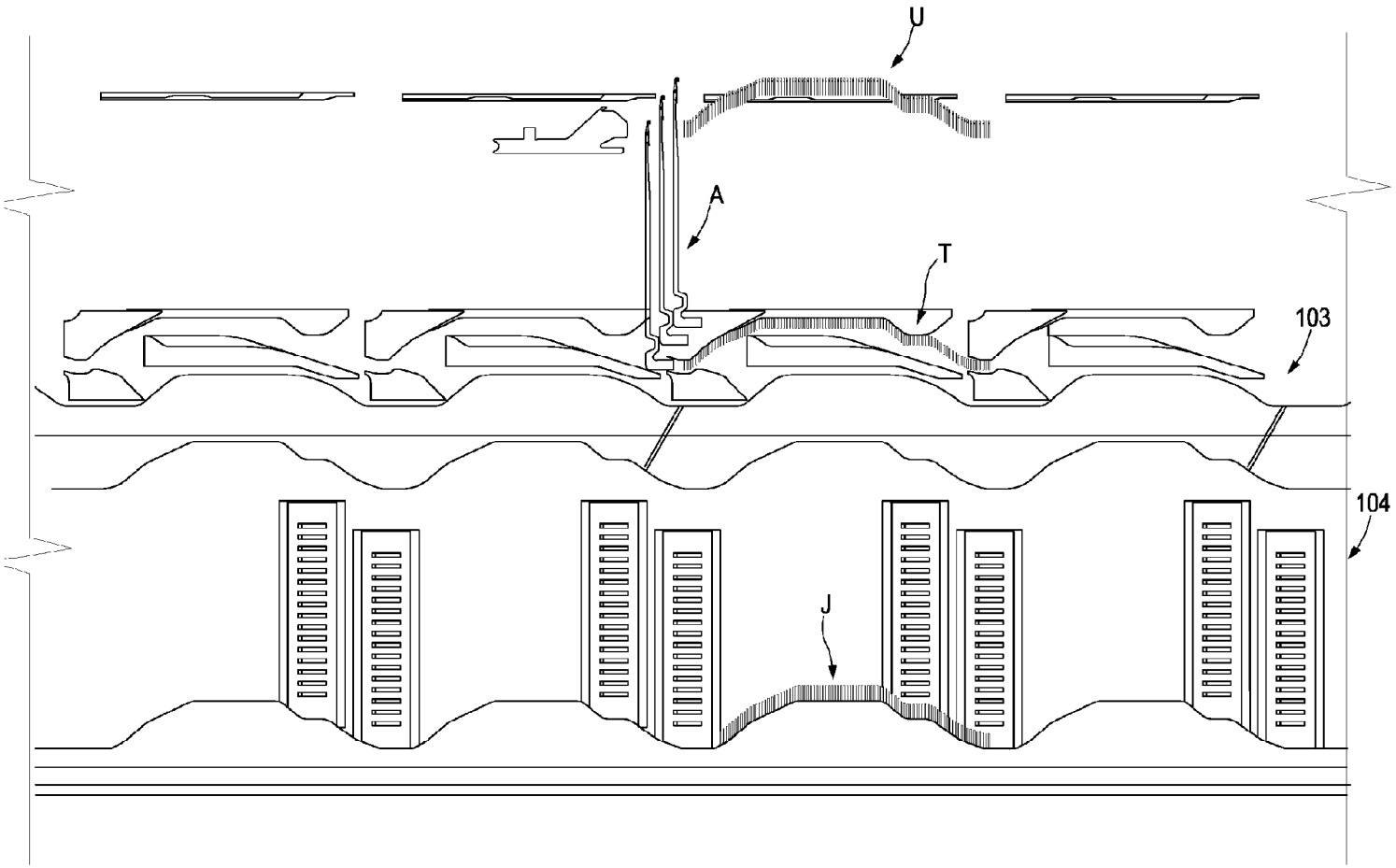
FIGS. 8, 9 and 10 show the scheme according to which the needles move in the end areas of the partial courses forming the two pockets of fabric.
Figure 9:
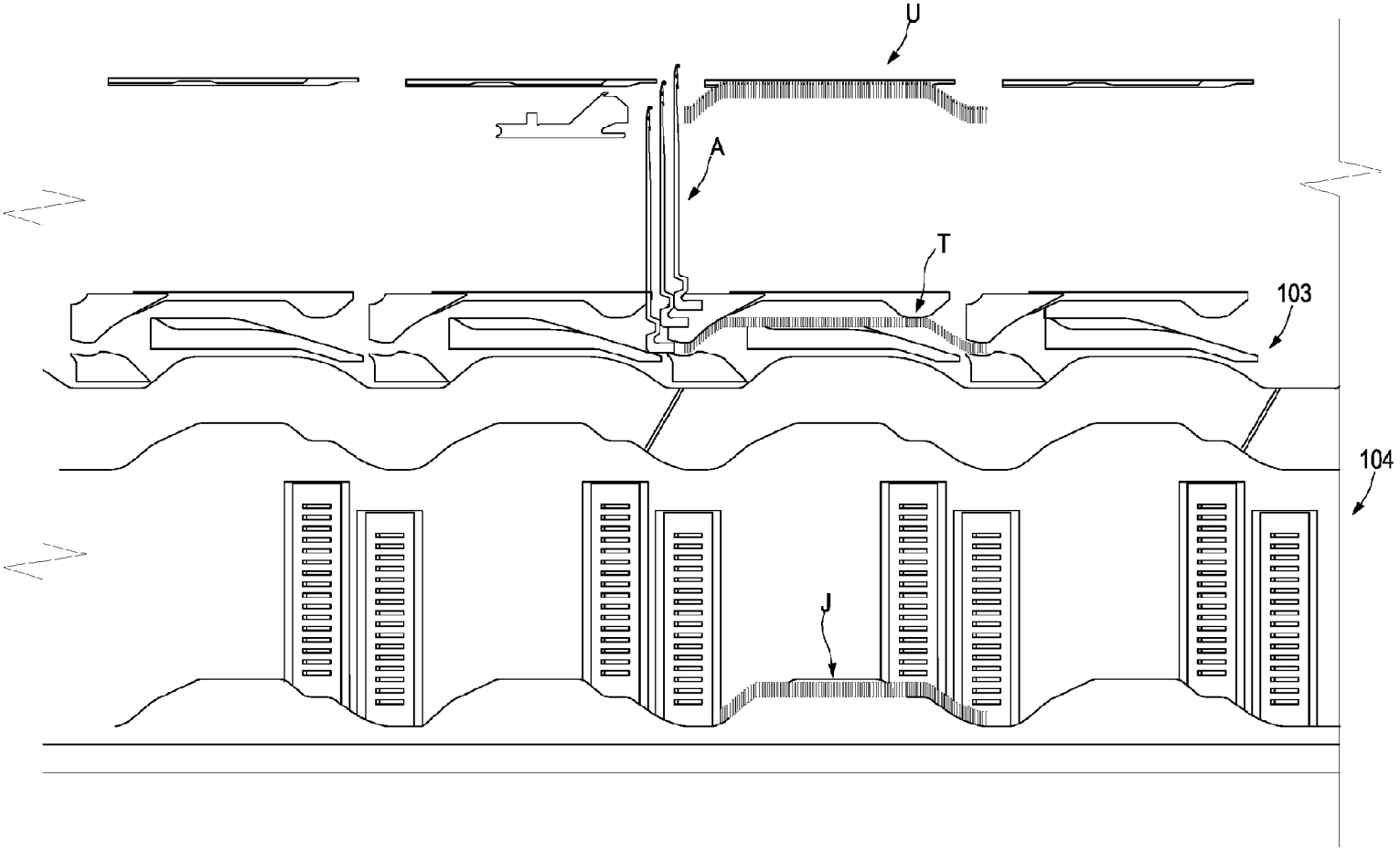
Figure 10:
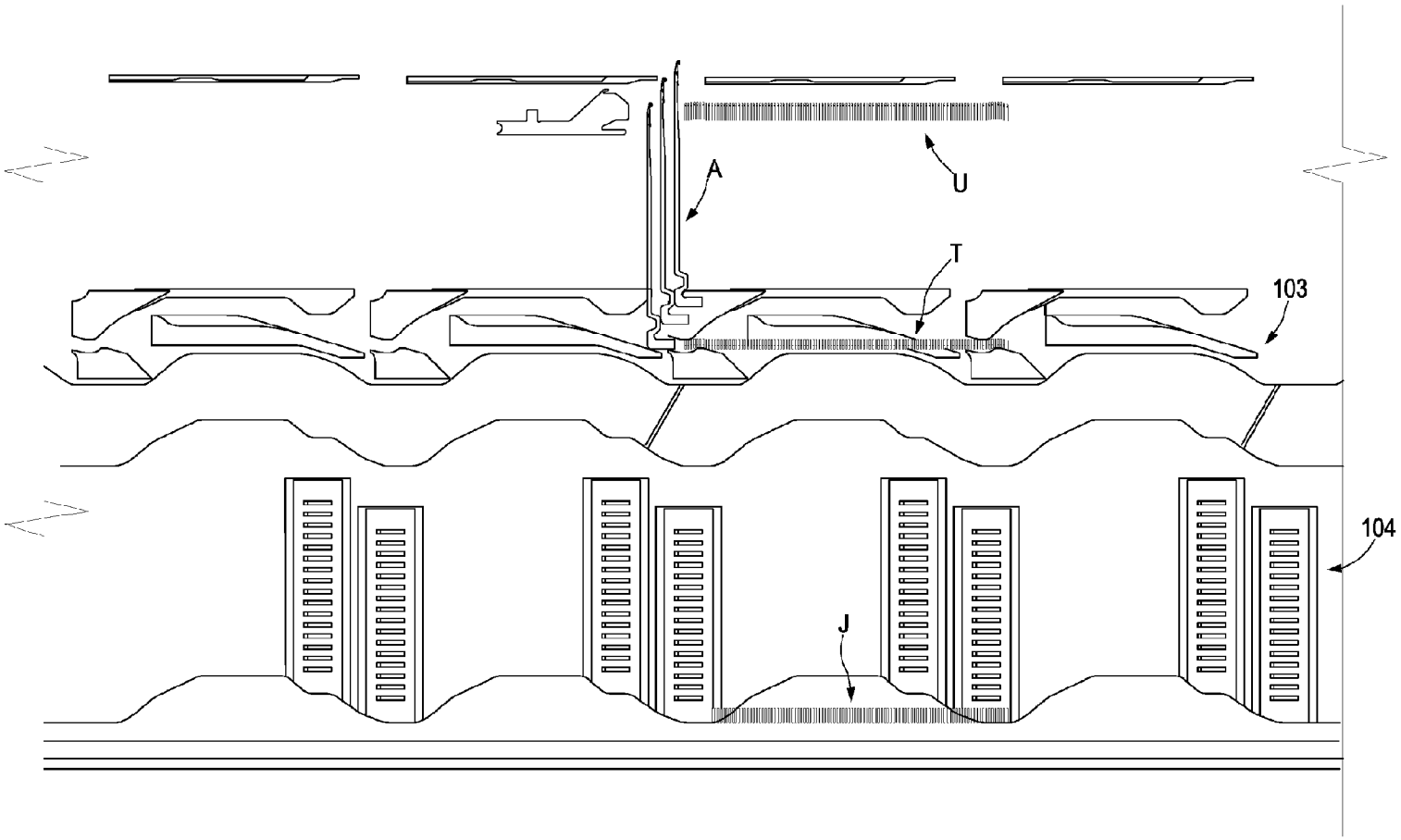

FIGS. 8, 9 and 10 show a plan view of the cams, with the four feeds with which the machine is provided and with the indication of the trajectory followed by the needles at cast off, held and low level respectively.

More in particular, FIG. 8 shows the trajectory of the hooks U and of the heels T of the cast off needles, i.e. the needles forming stitches. J indicates the trajectory of the heels of the jacks (not shown).

Analogously, FIG. 9 shows the trajectory of the hooks U and of the heels T, as well as of the jacks J, of the held needles, i.e. of the needles that, at the opposite ends of the partial courses, hold the cut yarns after each partial course has been formed.

FIG. 10 shows the trajectory of the hooks U, the heels T and the jacks J of the needles brought at low level at each end of the partial courses forming the pockets of fabric.

In the process described above it is assumed that an article or garment is produced with a body and two leg pieces, exiting from the circular knitting machine in a completely closed configuration, i.e. without openings for wearing the garment, and only provided, as the case may be, with openings at the ends of the leg pieces. The opening in correspondence of the waist for wearing the garment is produced, after the garment has been removed from the machine, by cutting along the line 13 and applying an elastic edge 11 according to known methods.

However, according to a preferred embodiment it is possible to produce the opening 13 in the knitted fabric formed on the circular knitting machine while knitting the body 7. FIGS. 12 to 22 show an embodiment of the process to make this opening. Each FIGS. 12A, 13A, 14A, 15A, 16A, 17A, 18A, 19A, 20A and 21A shows an enlargement of the corresponding area indicated with A in the respective FIGS. 12, 13, 14, 15, 16, 17, 18, 19, 20, 21.

FIGS. 12 to 21 schematically illustrate a top view of the circular needle bed, mounted on the needle cylinder 101 rotating according to arrow F101. In the illustrated example 400 needles are provided, wherein A1 indicates one of these needles, referred to as the first needle, and A400 indicates the needle adjacent to it, upstream of the needle A1 in the direction of rotation of the needle cylinder 101, referred to as the last needle. G1, G2, G3, G4 indicate four yarn guides, each of which feeds a respective yarn indicated with F1, F2, F3, and F4, corresponding to the four feeds with which the machine is provided in this exemplary embodiment.

The following description of the sequence of FIGS. 12 to 21 relates only to the operation for forming the opening 13 of the body 7 during the knitting in the circular machine. The remaining operation of forming decreases and increases in correspondence of the side pockets 17 and 19 are not described again as they are performed as already explained in the description above.

The opening 13 may be generated for instance only in the central portion 15 of the body, formed by circular fabric, or partially also in the side portions 17 and 19 forming the pockets of fabric defined by the increases and decreases as illustrated above. In general, the opening 13 is generated in a symmetrical position of the body 7, i.e. in a symmetrical position with respect to the median or anterior-posterior plane. The opening may be also moved forwards or backwards, and preferably forwards, so as to have more fabric in the buttocks area. As it will be clearly apparent from the following description, the position of the opening may be set and modified easily, simply selecting the needles.

For the sake of simplicity, in the description below the opening is positioned centrally and symmetrically.

In general, the opening 13 is formed during the knitting of the body 7 by cutting the yarns F1-F4 fed by the four feeds G1-G4 in correspondence of the same opening, so as to create an interruption in the fabric.

Figure 12:
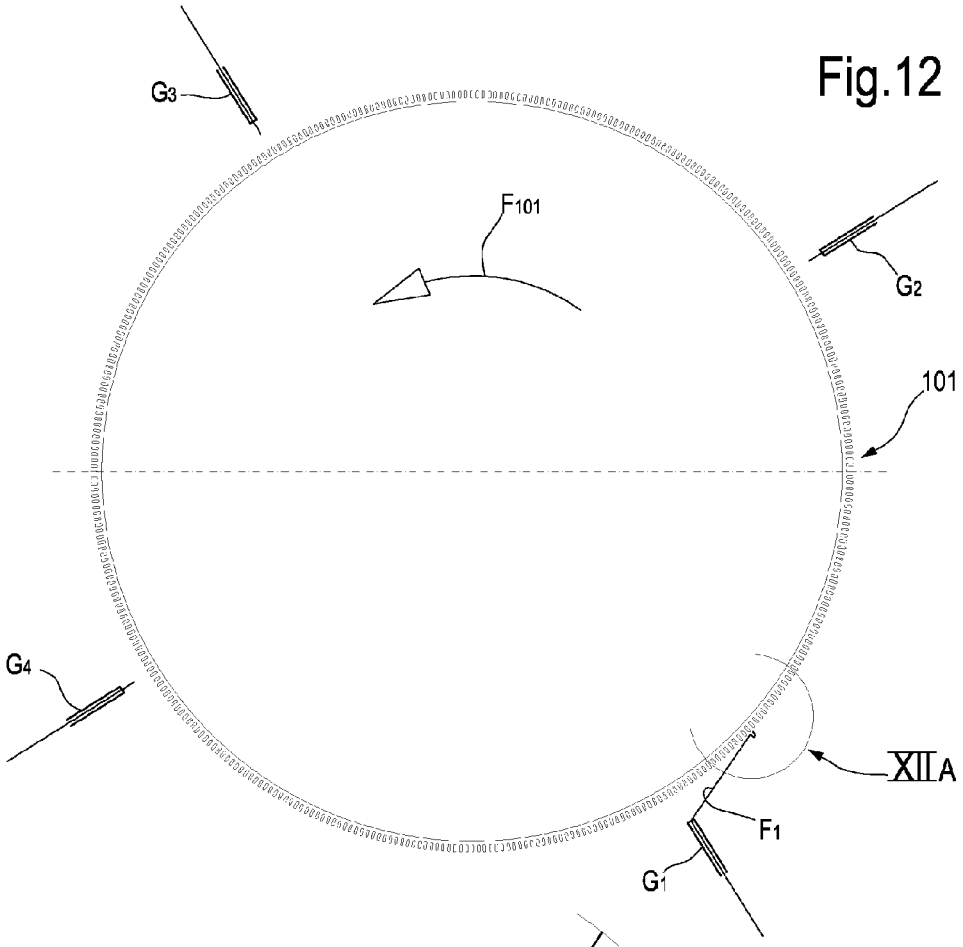
FIGS. 12 to 22 schematically show the method for producing in the body, during the knitting process, an opening in correspondence of which an elastic edge will be subsequently applied.
Figure 12A:
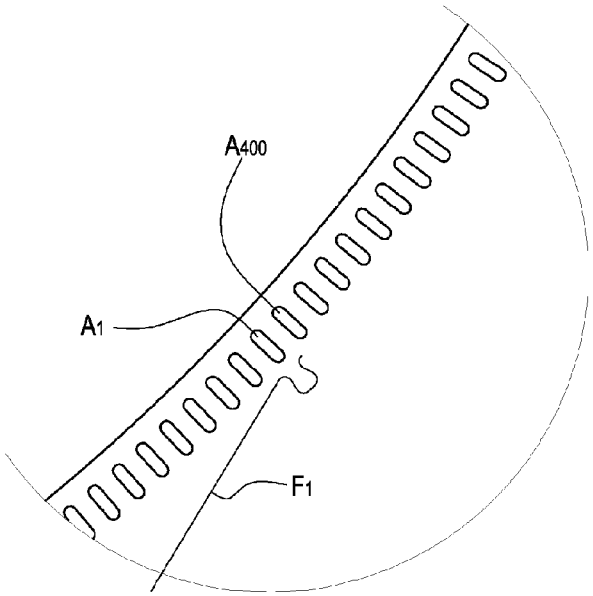
Figure 13:
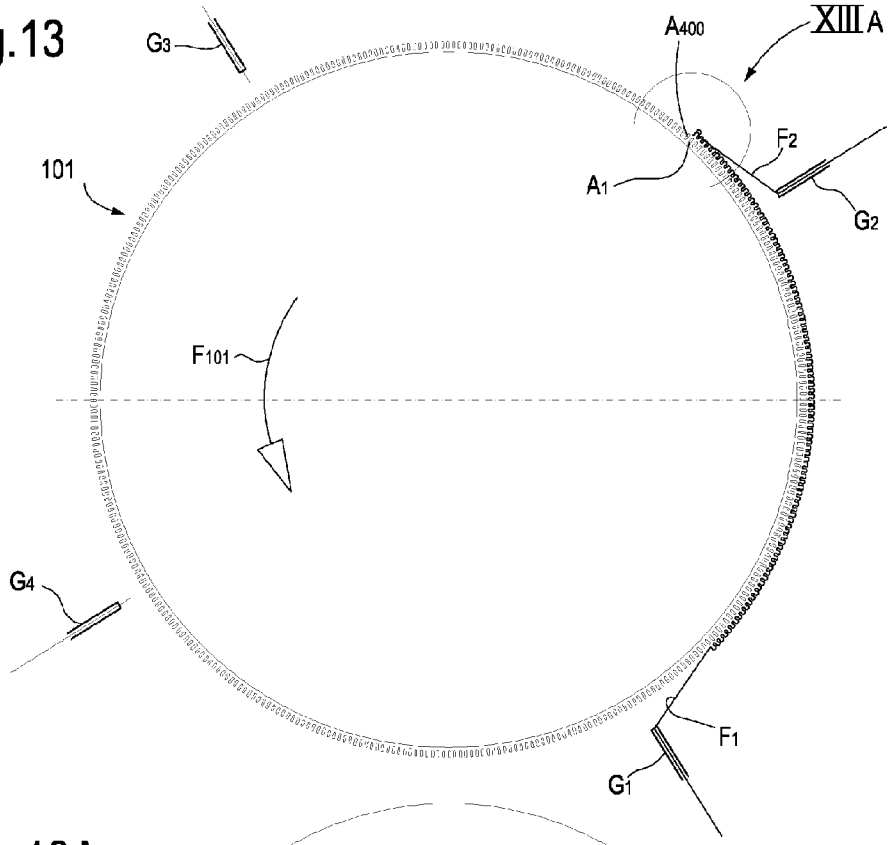
Figure 13A:
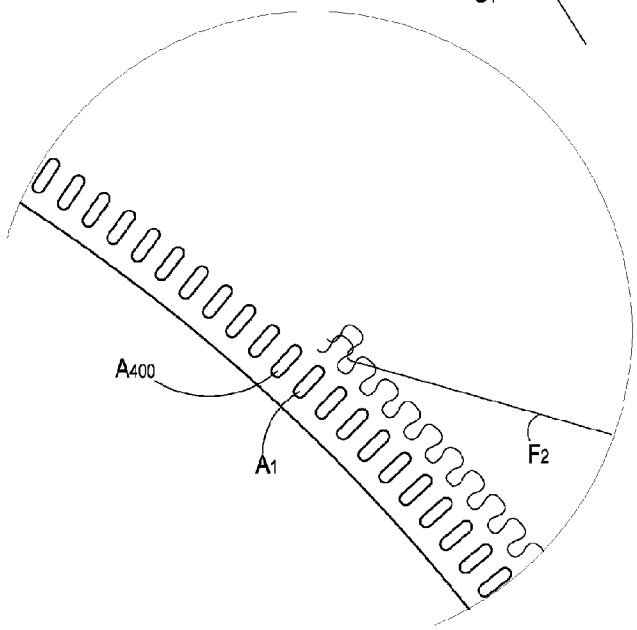

FIGS. 12, 12A illustrate the instant where formation of an opening 13 in the body 7 starts, during knitting on the circular machine More in particular, the yarn F1 from the first yarn guide or feed G1 is engaged by the needle A1 starting the formation of the first course of stitches corresponding to the beginning of the opening 13. As the needle cylinder, indicated as a whole with number 101, rotates in counterclockwise direction according to arrow F101 in the illustrated example, the formation of the first course by means of the yarn F1 from the feed defined by the yarn guide G1 continues as illustrated in the subsequent FIGS. 13 and 13A. In these figures the needle A1 has passed the position of the second yarn guide or feed G2 and the second yarn F2 of the second feed has been engaged by the needle A1 that starts knitting the second course, a first stitch being illustrated in the enlargement of FIG. 13A.

Figure 14:
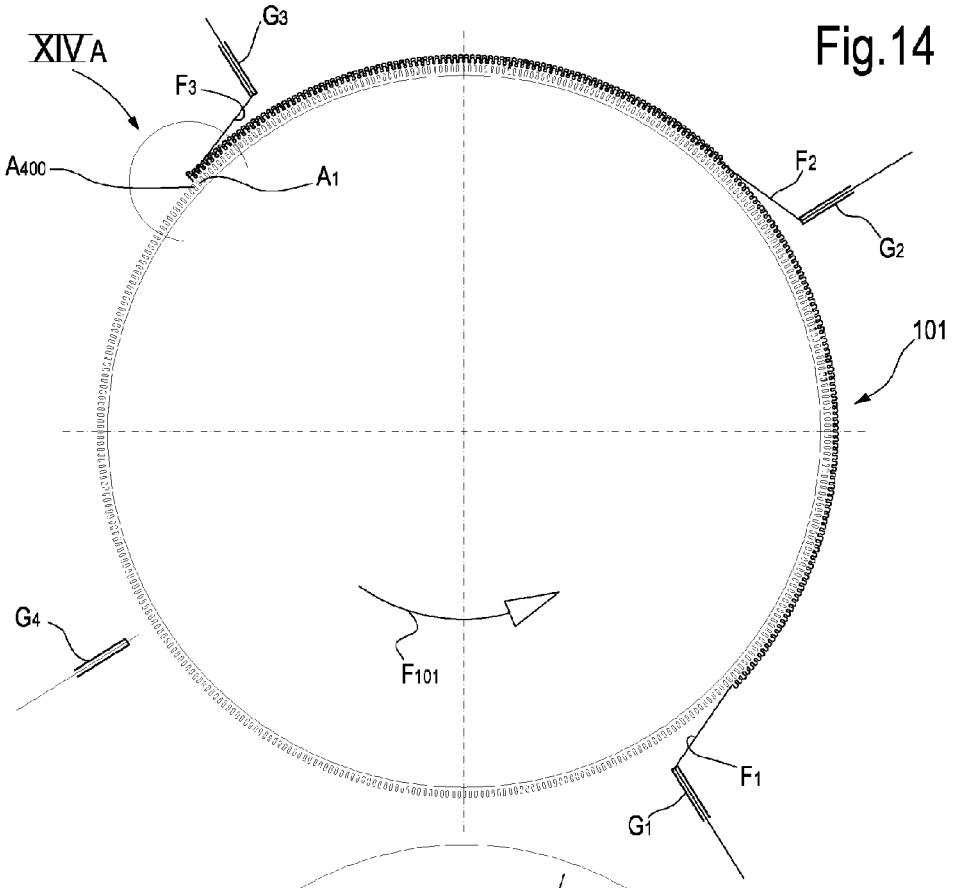
Figure 14A:
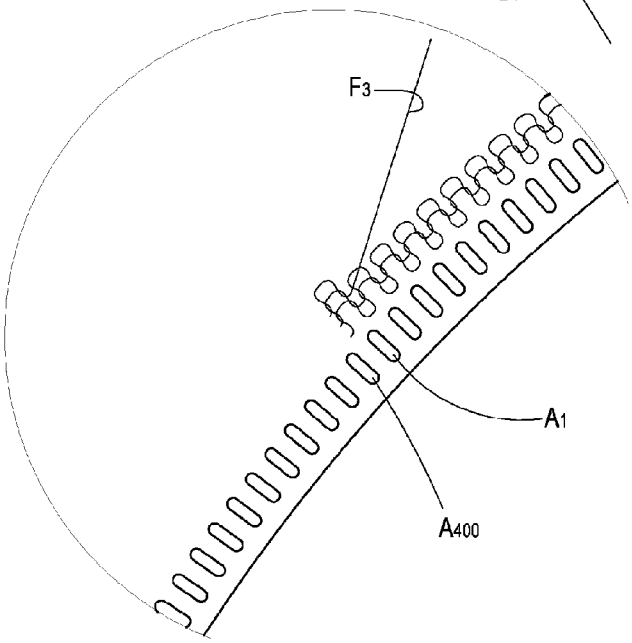
Figure 15:
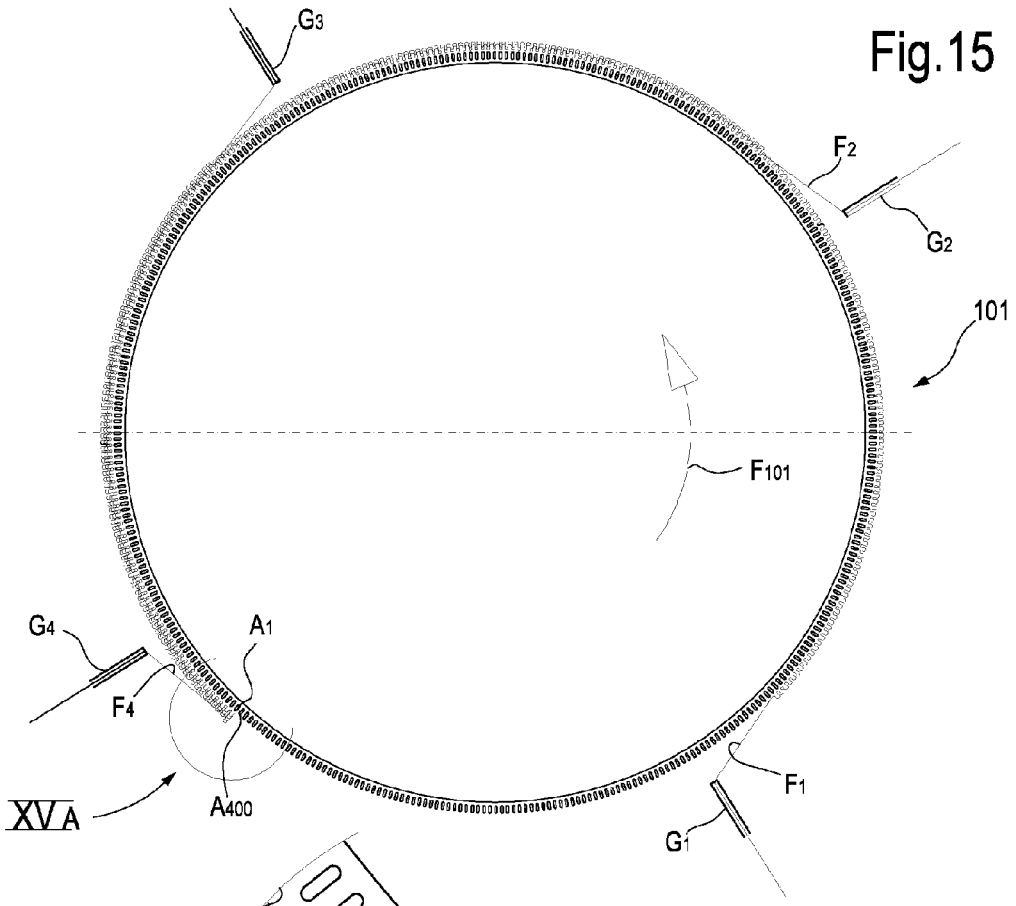
Figure 15A:
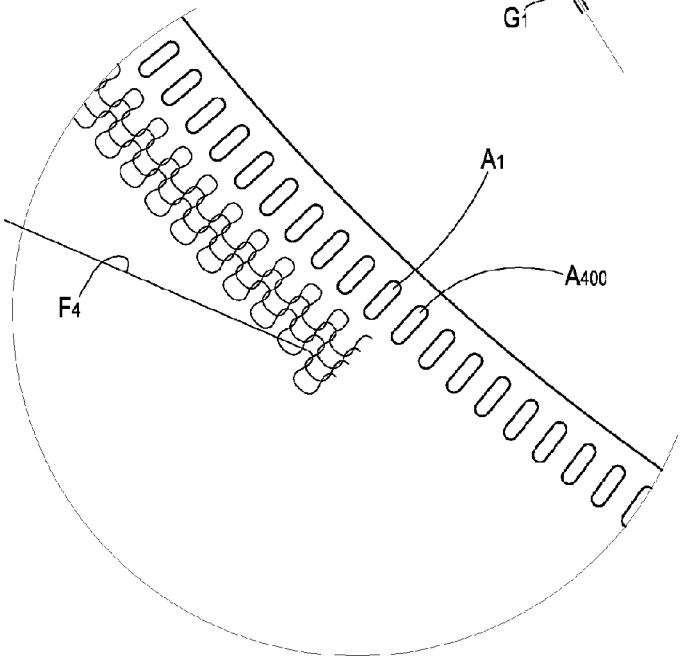

Continuing the rotation, in FIGS. 14 and 14A the first needle A1 passes in front of the third yarn guide G3 embodying the third feed, and starts to form the third course of stitches with the yarn F3 of the third feed. Continuing the rotation according to arrow F101, as shown in FIGS. 15, 15A, the first needle A1 passes in front and beyond the fourth yarn guide G4 embodying the fourth feed, and, by means of the yarn F4, starts the formation of the fourth course.

Figure 16:
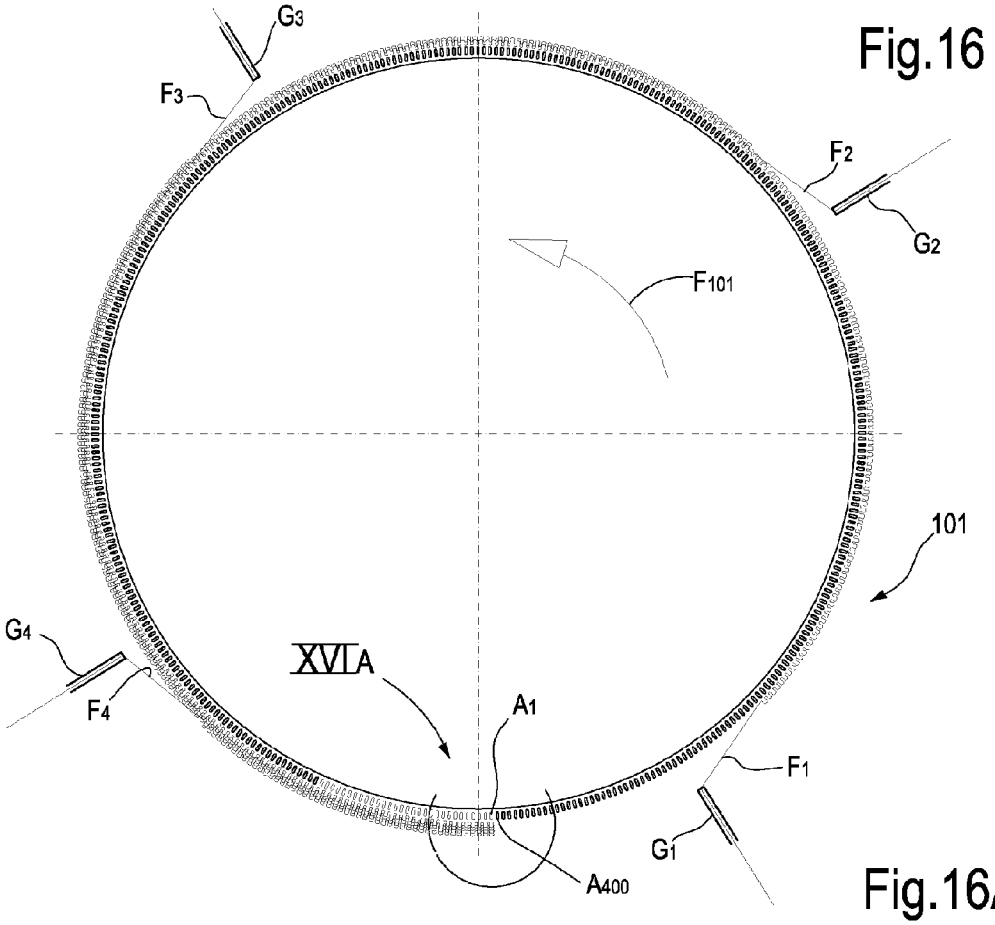
Figure 16A:
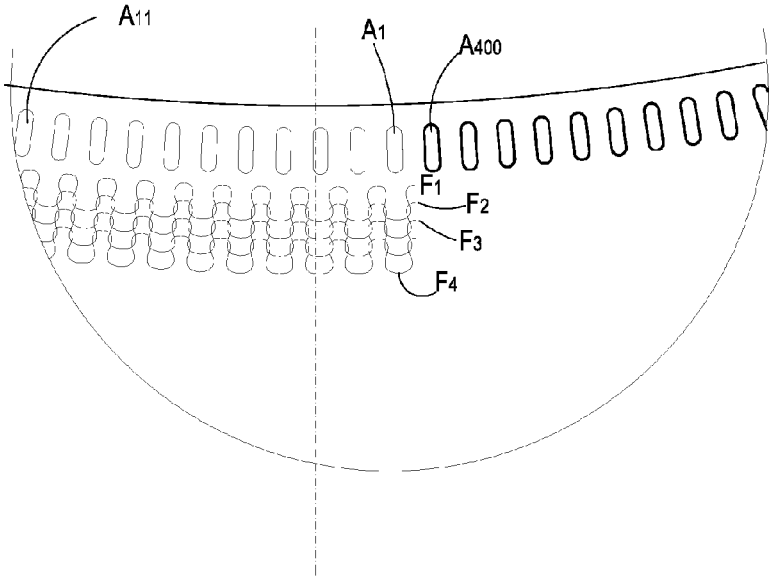
Figure 17:
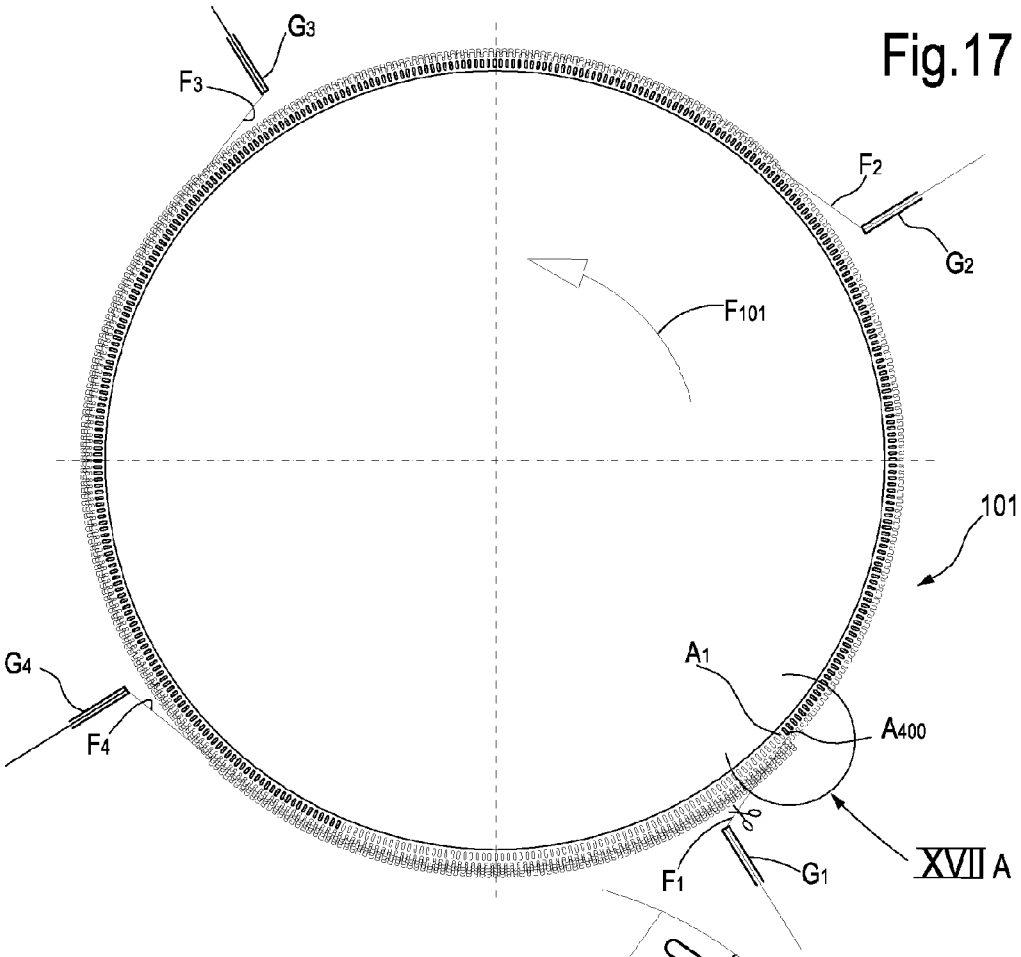
Figure 17A:
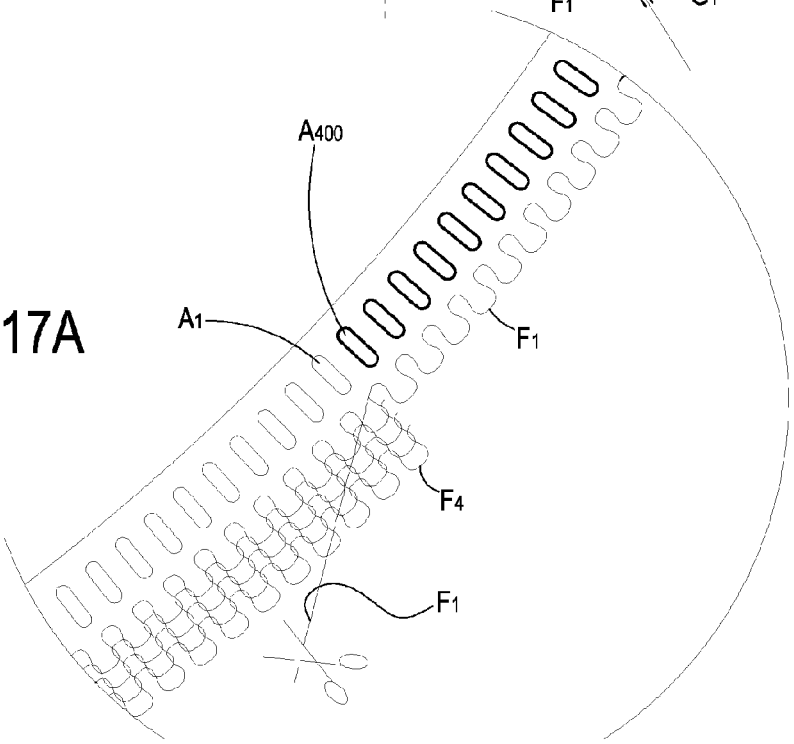
Figure 18:
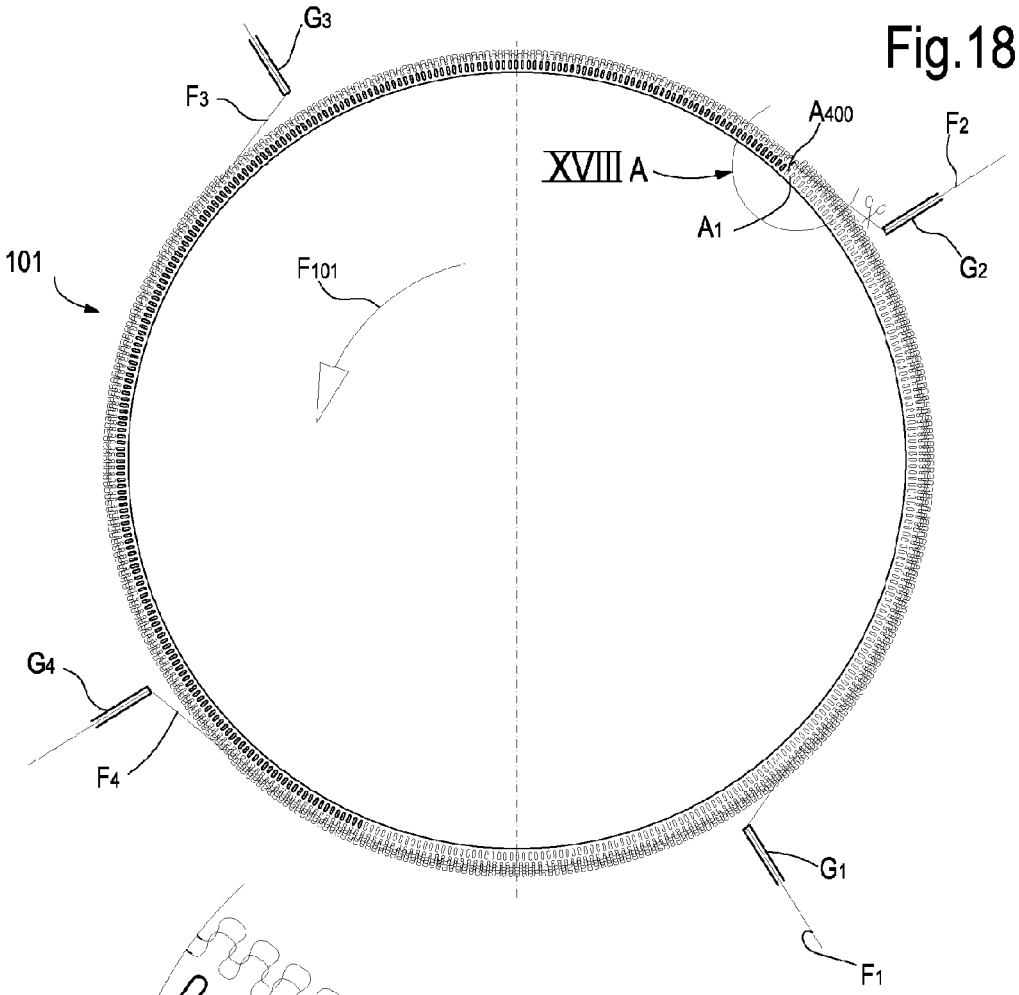
Figure 18A:
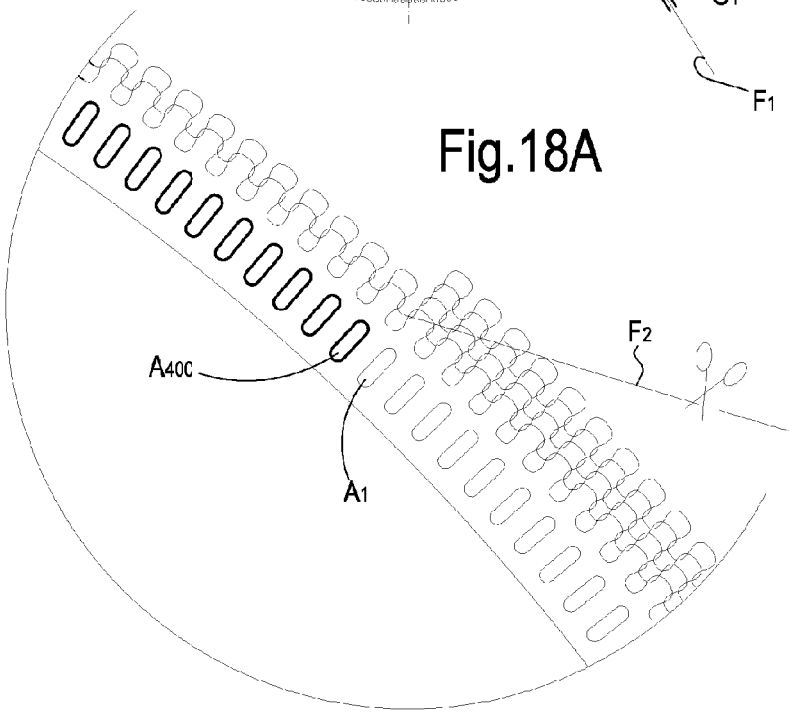

Passing through the position illustrated in FIGS. 16 and 16A, the cylinder 101 continues to rotate according to arrow F101 and achieves the position illustrates in FIGS. 17 and 17A, wherein the first yarn F1 is engaged by the last needle A400 of the circular needle bed so as to complete the first course of stitches. At this point the yarn F1 of the first feed is cut as schematically shown by the scissors shown in FIG. 17A. Now the interruption of the fabric starts, resulting in the formation of the opening 13 in the finished article.

As the courses formed by means of the yarns F2, F3 and F4 fed by the feeds G2, G3 and G4 are not still completed, the needle cylinder 101 continues to rotate according to arrow F101 as shown in the subsequent sequence of FIGS. 18, 19, 20 and 21, while the needles, starting from the needle A1, are gradually brought out of work as they pass beyond the fourth feed corresponding to the fourth yarn guide G4.

Figure 21:
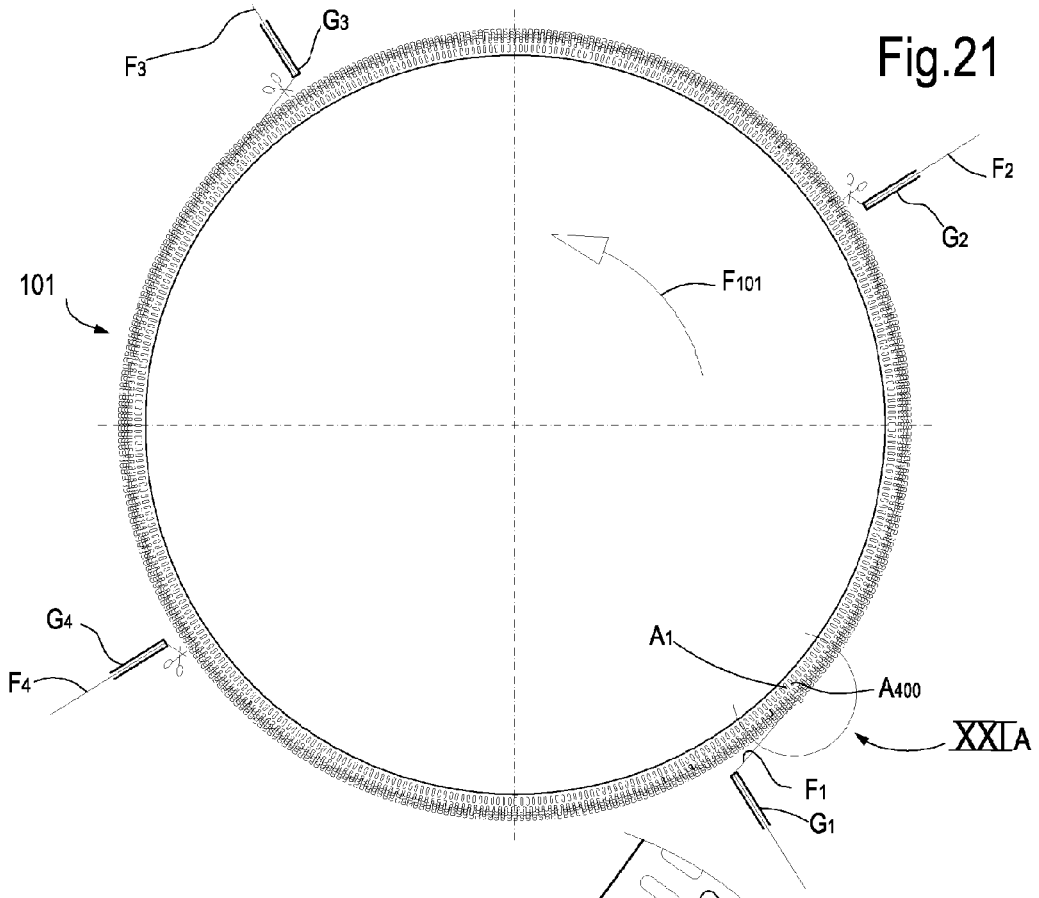
Figure 21A:
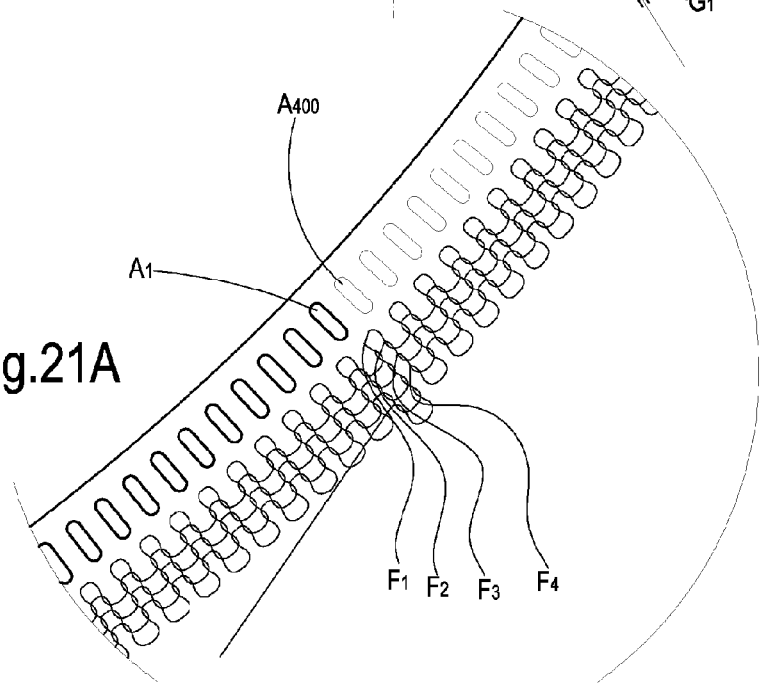

Continuing this rotation, the needles A1-A400 continue to rotate in front of the yarn guides G1-G4 until, as shown in FIG. 21 and in the enlargement of FIG. 21A, the formation of the fourth course has been completed by means of the yarn F4 from the fourth feed corresponding to the fourth yarn guide G4.

As the needle A400 passes in front of the feeds G2, G3 and G4, the yarns F2, F3 and F4 are cut. For instance in FIG. 18 and in the enlargement of FIG. 18A the step is shown, wherein the 400th needle A400 passes in front of the yarn guide G2 completing the second course, so that the second yarn F2 can be cut as schematically represented by the scissors in FIG. 18A.

Figure 19:
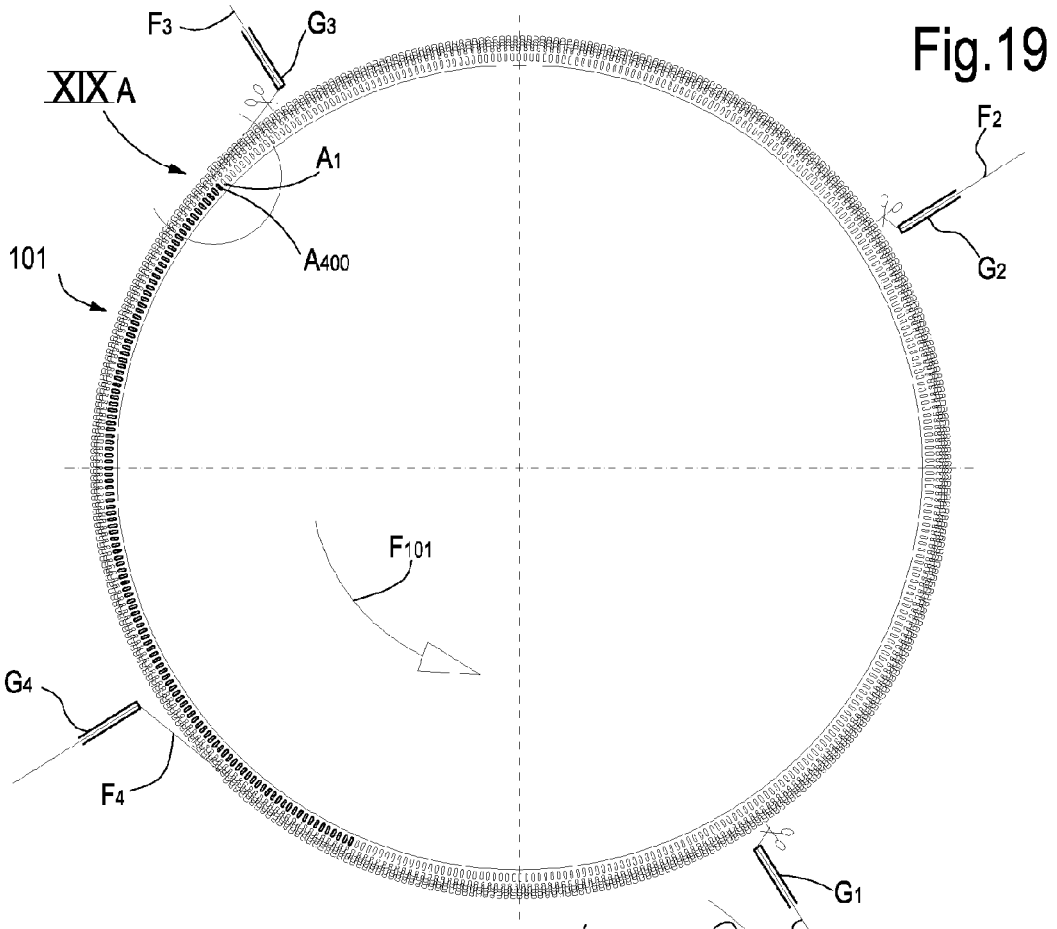
Figure 19A:
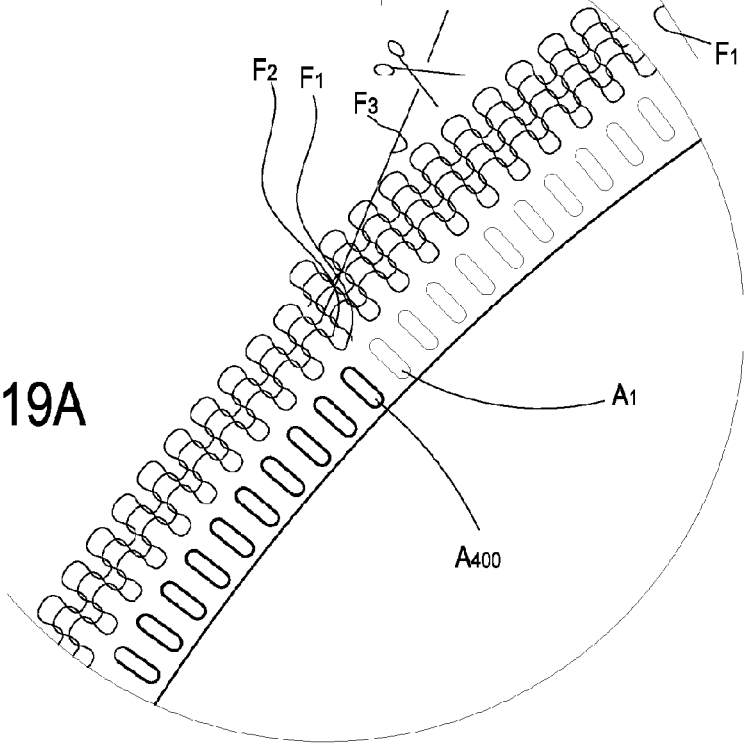

Analogously, in FIG. 19 and in the enlargement of FIG. 19A the moment is shown when the needle A400 has completed the last stitch of the third course passing in front of the yarn guide G3 corresponding to the third feed, and the third yarn F3 is cut.

Figure 20:
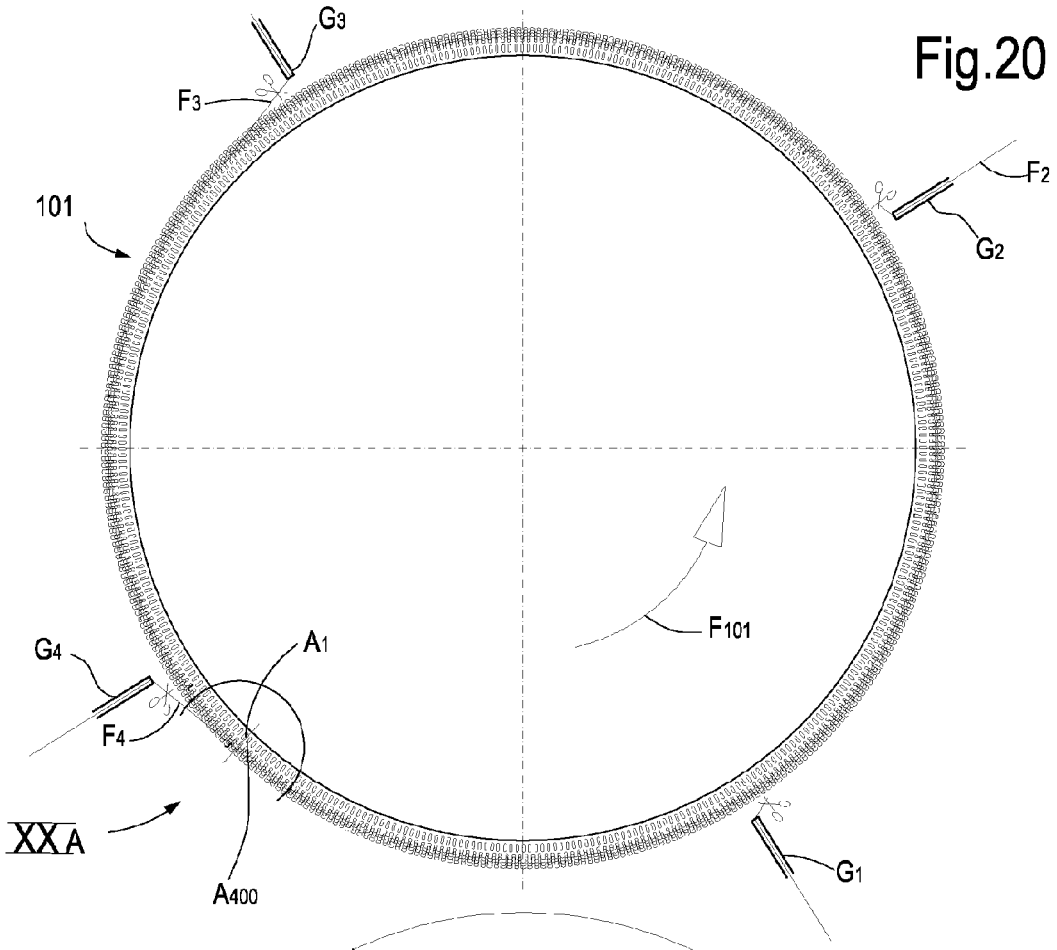
Figure 20A:
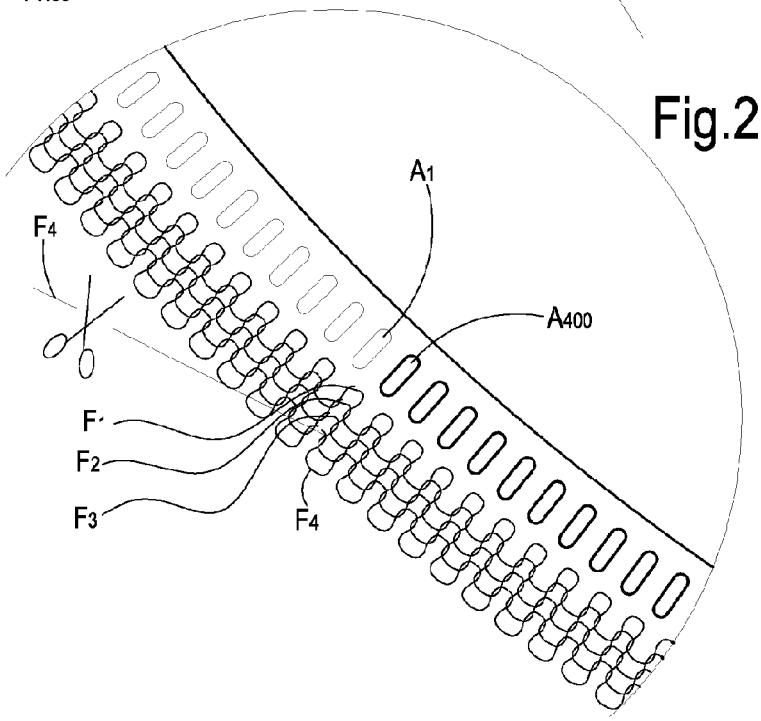

In FIG. 20 the needle A400 has passed in front of the yarn guide G4 completing the fourth course formed by the fourth yarn F4 coming from the fourth feed corresponding to the fourth yarn guide G4. The yarn F24 is cut (FIG. 20A).

In FIGS. 21, 21A the angular position of the needle cylinder 101 almost coincides with the position of FIGS. 12 and 12A. The yarn F1 of the first feed, coming from the first yarn guide G1 and previously cut, is engaged again by the first needle A1 of the circular needle bed of the cylinder 101 to start the formation of the fifth course.

The process starts again as described above to form a further set of four courses with the yarns F1-F4. This process is repeated for the number of times necessary to form the opening 13.

As every time a course is completed by means of the needles A1-A400 of the needle cylinder 101 the respective yarn F1-F4 is cut, the fabric formed in this step in correspondence of the body 7 is not continuous, but has an interruption coinciding with the cut of the single yarns F1-F4 in all the courses formed up to the completion of the opening 13.

It should be noted that during the formation of this opening the number of revolutions of the needle cylinder 101 is substantially double the number that would be necessary in case the fabric remains continuous, i.e. without the opening 13. This occurs because, in order for each yarn F1-F4 to generate a complete course, it is necessary that the cylinder 101 makes a complete revolution, with all the needles A1-A400 passing in front of each respective feed G1-G4. So, for instance, it should be noted that the needles A1-A400 generate the first course with the yarn F1 of the feed G1 while the needle cylinder 101 rotates by about 360° from the position of FIGS. 12, 12A to the position of FIGS. 17, 17A. At this point the yarns F2, F3, F4 of the feeds corresponding to the yarn guides G2, G3, G4 do not have yet completed the formation of the respective courses and therefore the needle cylinder 101 continues to rotate by further 360° C. from the position of FIGS. 17, 17A up to the angular position of FIGS. 21, 21A. During this subsequent revolution no yarn is fed by the feed G1 and the yarn F1 does not form stitches. The same occurs, with a displacement by 90°, 180° and 270° respectively, for the remaining yarns F2-F4. Once it has been cut (FIGS. 17, 17A), the yarn F1 starts again to form stitches only when the needle cylinder 101 passes beyond the angular position of FIG. 21, 21A and returns into the angular position of FIGS. 12, 12A, where the needle A1 engages again the head of the yarn F1 previously cut, to start the formation of the subsequent course with said yarn F1. The same occurs for all the remaining yarns F2-F4.

It should be noted that once the needle A1, i.e. the first needle taken into account in the circular bed of the needle cylinder 101, has passed in front of all the four feeds G1-G4, and has therefore formed stitches with the four yarns F1-F4, it goes out of work and remains out of work up to the completion of the second revolution of the needle cylinder 101. The same occurs for the needles after the needle A1, that are gradually brought out of work as they complete the formation of the fourth course with the fourth yarn F4 coming from the fourth feed embodied by the yarn guide G4.

In the enlargements of FIGS. 16-21 the operative needles are indicated with a bold line, while the inoperative needles are indicated with a thinner line. So for instance in FIGS. 16, 16A the first needle A1 is indicated with a thin line and similarly the ten subsequent needles up to the needle A11. The needles A12 to A400 are still in work. As the needle cylinder 101 continues to rotates, the needles passing in front of the fourth feed G4 are gradually brought out of work up to the completion of the second complete rotation of the needle cylinder 101.

Figure 22:
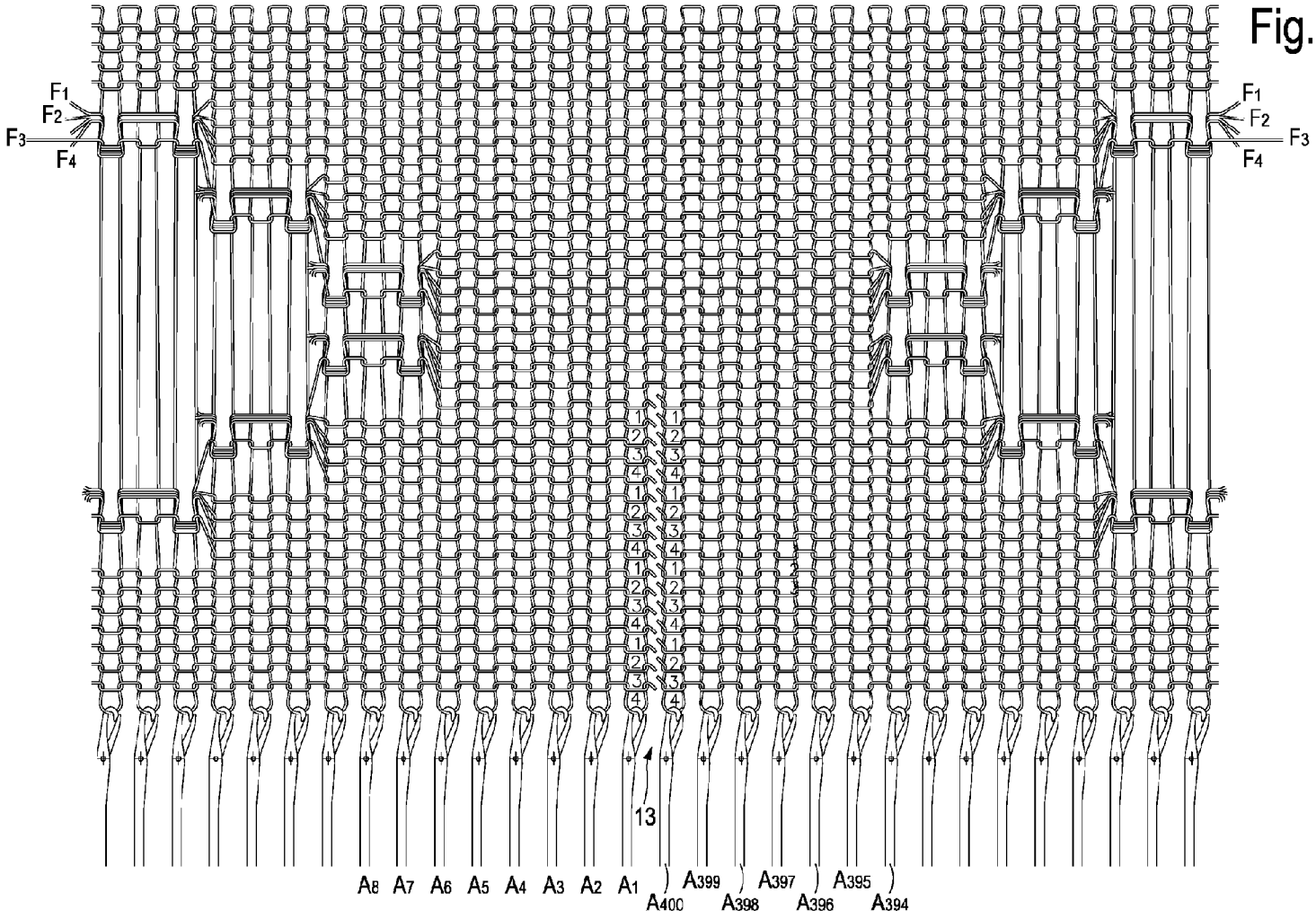

FIG. 22 shows the final result of the process of formation of the opening 13 in a portion of fabric of the body 7 and more precisely in an area where there are also the partial courses of increasing length forming the portion 17C of the pocket 17. In the intermediate position between the needles A1 and A400 the yarns F1-F4 forming the courses in sequence are interrupted generating the opening 13 while knitting the body 7.

The elasticity of the yarn is sufficient to avoid laddering of the stitches adjacent to the interruption forming the opening 13. If necessary, it is possible to select adequately the needles in the area of formation of the stitches adjacent to the cut point of the yarns F1-F4 to make the fabric run-proof. The selection for forming run-proof fabric is known and does not require further detailed explanation herein.

The description above relates to a machine with four feeds, allowing particularly reduced production times. This number of feeds is the preferred one, however it should be understood that it is just a non-limiting example, as the method described below can be done also with a different number (greater or smaller) of feeds.

The embodiments described above and illustrated in the drawings have been explained in detail as examples of embodiment of the invention. It will be clearly apparent to those skilled in the art that modifications, variants, additions and omissions are possible, without however departing from the principles, the scope of the concept and the teachings of the present invention as defined in the attached claims. The scope of the invention shall be therefore determined exclusively based upon the widest interpretation of the attached claims, wherein these modifications, variants, additions and omissions are included within this scope. The terms "comprising" "to comprise" and the like do not exclude the presence of further elements or steps in addition to those specifically listed in a claim. The term "a" or "an" before an element, means or feature of a claim does not exclude the presence of a plurality of these elements, means or features. If a claim of a device claims a plurality of "means", some or all these "means" can be actuated by a single component, member or structure. The enunciation of given elements, features or means in distinct depending claims does not exclude the possibility of combining said elements, features or means together. When a method claim lists a sequence of steps, the sequence with which these steps are listed is not binding and can be changed, if the particular sequence is not indicated as binding. Any reference numerals in the appended claims are provided to facilitate reading of the claims with reference to the description and to the drawing, and do not limit the scope of protection represented by the claims.

The invention claimed is:

1. A method for producing a knitted article with two leg pieces and a body on a circular knitting machine with at least one circular needle bed, the method comprising the following steps:

knitting a first leg piece with continuous motion;

knitting a first pocket of fabric, forming a first side part of said body, with continuous motion starting from a last course of the first leg piece, by knitting a first sequence of partial courses with continuous motion, starting from the last course of the first leg piece, gradually reducing a number of operating needles, to partial courses of gradually decreasing length up to a partial course of minimal length, and by knitting a second sequence of partial courses with continuous motion, starting from the partial course of minimal length, gradually increasing the number of operating needles, to form partial courses of gradually increasing length up to form a complete course, wherein, after each partial course of said first sequence of partial courses and of said second sequence of partial courses has been knitted, the yarn that has formed each partial course is cut;

knitting a central part of said body with continuous motion;

knitting a second pocket of fabric with continuous motion starting from the central part of the body up to a start course of a second leg piece, by knitting a third sequence of partial courses, starting from a last complete course of the central part of the body, gradually reducing the number of operating needles, to form partial courses of gradually decreasing length up to a partial course of minimal length, and by knitting a fourth sequence of partial courses, starting from the partial course of minimal length, gradually increasing the number of operating needles, to form courses of gradually increasing length up to bring again the whole circular needle bed to operate, wherein, after each partial course of said third sequence of partial courses and of said fourth sequence of partial courses has been knitted, the yarn that has formed each said partial course is cut;

knitting said second leg piece with continuous motion starting from the start course, wherein the gradual reduction of the number of operating needles is performed by stopping a plurality of needles from operating at each end of the partial courses, that hold a cut end of the yarns, wherein each plurality of needles brought out of work at each end of the partial courses comprises an intermediate needle, brought into a low position to form a float loop, and two needles adjacent to the intermediate needle that are brought in held position.

2. A method according to claim 1, wherein all the knitting steps are performed with an even number of feeds.

3. A method according to claim 1, wherein said central part of the body has a tubular structure formed by a plurality of circular courses of stitches.

4. A method according to claim 1, wherein, after the first sequence of partial courses has been knitted and before knitting the second sequence of partial courses, a complete course is knitted through the whole circular needle bed with the yarn of at least one feed.

5. A method according to claim 1, wherein said step of knitting said central part of said body with continuous motion is performed using the whole circular needle bed, knitting a tubular portion of fabric.

6. A method according to claim 1, wherein, after the third sequence of partial courses has been knitted and before knitting the fourth sequence of partial courses, a complete course is knitted through the whole circular needle bed.

7. A method according to claim 1, wherein said plurality of needles comprises at least three needles.

8. A method according to claim 1, wherein the gradual increase in the number of operating needles is performed bringing again a respective plurality of needles at each end of the partial courses to operate.

9. A method according to claim 1, wherein said plurality of needles comprises three needles, said three needles comprising said intermediate needle and said two needles adjacent to said intermediate needle, said two needles comprising two end needles, wherein in each triad of needles the intermediate needle is brought into a low position to form a float loop, and the two end needles are brought into held position.

10. A method according to claim 1, further comprising the step of cutting at least the central part of the body to form an opening.

11. A method according to claim 1, further comprising the step of generating an opening in the fabric while knitting at least a part of the body.

12. A method according to claim 11, wherein during at least one part of the knitting of the body with continuous motion the yarns of each feed are interrupted or cut when a respective course is ended to generate said opening.

13. A method according to claim 12, wherein during said part of the knitting of the body when the opening is formed, the circular needle bed rotates a number of times equal to twice a number of interrupted courses forming said opening.

14. A method according to claim 1, further comprising the step of applying an elastic edge around said opening.

15. A method according to claim 1, further comprising the step of closing ends of the leg pieces.

16. A knitted garment comprising:

a body and two tubular leg pieces, wherein the body comprises a central part and two side pockets of knitted fabric, each of said two side pockets being formed by a first series of partial courses constituting an extension of a knitted fabric forming the tubular leg pieces, the courses of said first series of partial courses having decreasing length starting from a complete final course of a respective one of said leg pieces up to a partial course of minimal length of a respective one of said two side pockets, and each of said two side pockets being formed by a second series of partial courses arranged between a respective course of minimal length and the central part of the body and having increasing length starting from the respective partial course of minimal length up to a respective complete course of the central part of the body, the partial courses of the pockets of fabric being formed by cut yarns, wherein said cut yarns form, at ends of the partial courses, multiple stitches and floated loops comprised between said multiple stitches.

17. A knitted garment according to claim 16, wherein the central part of the body is produced by a knitted fabric having a structure obtained by knitting with continuous motion.

18. A knitted garment according to claim 16, wherein said central part of the body, said leg pieces and the two side pockets of fabric are formed by yarns of at least two feeds.

19. A knitted garment according to claim 16, wherein the partial courses of two adjacent portions of each of said two side pockets are distributed along joining lines and a complete course extends along the joining lines.

20. A method according to claim 1, wherein all the knitting steps are performed with at least two feeds.

21. A method according to claim 1, wherein all the knitting steps are performed with at least four feeds.

22. A method according to claim 1, wherein all the knitting steps are performed with at least one S-yarn and at least one Z-yarn.

23. A method according to claim 1, wherein said plurality of needles comprises three needles.

* * * * *